US005927719A

United States Patent [19]

Young

[11] Patent Number: 5,927,719

[45] Date of Patent: Jul. 27, 1999

[54] REGION-SUITED GEOGRAPHY PLAYING CARD DECK WITH MAIN INFORMATION AND PLACE-FILLER SUIT CARDS; A COMPANION DECK; AND GAMES

[76] Inventor: Olivia L. Young, 6135 N. Lindbergh Blvd., Hazelwood, Mo. 63042

[21] Appl. No.: 08/802,588

[22] Filed: Feb. 19, 1997

[51] Int. Cl.[6] ..... A63F 1/00

[52] U.S. Cl. ..... 273/302; 273/308; 434/130

[58] Field of Search ..... 273/302–306, 273/308, 292, 299, 296; 434/130

[56] References Cited

U.S. PATENT DOCUMENTS

| | | | |
|---|---|---|---|
| 229,914 | 7/1880 | Read | 273/302 |
| 357,184 | 2/1887 | Dealy | 273/302 |
| 506,648 | 10/1893 | McGeorge et al. | 273/302 |
| 787,295 | 4/1905 | Higgins | 273/302 |
| 791,118 | 5/1905 | Wade | 273/302 |
| 1,123,622 | 1/1915 | Tercy | 273/302 |
| 1,269,320 | 6/1918 | Scholz | 273/302 |
| 1,273,024 | 7/1918 | Branch | 273/302 |
| 1,292,184 | 1/1919 | Wells | 273/302 |
| 1,489,541 | 4/1924 | Miller | 273/302 |
| 4,084,816 | 4/1978 | Shafer | 273/299 |
| 5,141,235 | 8/1992 | Hernandez | 273/308 |

OTHER PUBLICATIONS

Wayland, Virginia Dec. 1967 The Winstanley Geographical Cards.

Tilley, Roger Dec. 1973 A History of Playing Cards.

Wowk, Kathleen Dec. 1983 Playing Cards of the World.

*Primary Examiner*—Benjamin H. Layno

[57] ABSTRACT

This invention comprises a method for teaching/learning about the general location of major political units of contemporary society using a series of sets of decks of geography playing cards; each set of decks comprises a world regions deck, a suited country card deck, an unsuited country card deck and a blotswanna card deck. The world regions card deck represents contemporary settled earth and comprises a plurality of continental landmass area suits and a plurality of region cards. Each suited country card deck represents one continental area and comprises a plurality of region suits and a plurality of political unit or country cards. Each unsuited country card deck also represents one continental area and comprises a plurality of political unit or country cards. World regions and country card decks provide three different, and increasing, levels of card play difficulty. A blotswanna card deck comprises a plurality of cards, as well, and is used to structure the card play of regions and country card decks. Blotswanna cards structure use by mandating player compilation of a particular combination of cards from a deck and assigning varying point values to mandate achievement, from hand-to-hand of play. The blotswanna card deck, thus, structures learning and heightens excitement. Other novel features include improved directional-suit configurations and improved directional-suit naming conventions. Use of place-filler cards in country card decks enables development of locational suited decks wherein the suits of a deck have identical numbers of suit cards. Identical numbers of suit cards facilitate the play of adaptations of a number of popular card games. A card game developed for use with the invention and a version of the invention for use by young children are also included.

11 Claims, 3 Drawing Sheets

REGION-SUITED GEOGRAPHY PLAYING CARD DECK WITH MAIN INFORMATION AND PLACE-FILLER SUIT CARDS; A COMPANION DECK; AND GAMES

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention pertains to the field of playing cards in general and geography playing cards in particular (U.S. Classification 273/302). Playing cards have been used to amuse and educate human beings since the 14th century. at least. Cards have undergone a number of design improvements but the basic structure of a standard deck of playing cards has endured, unchanged, for many centuries. Even with the advent of exciting new electronic games, playing cards continue to be a popular leisure time activity enjoyed by children and adults alike.

The Standard Playing Card Deck

Structurally, the standard deck of playing cards consists of 52 cards divided into four groups called suits. Cards of one suit are distinguished from the cards of other suits by different suit-marks. The familiar French suit-marks of hearts, spades, diamonds and clubs are most commonly used by American playing card manufacturers. Within a suit, the cards of the standard deck are distinguished from each other by indices of the card's number or rank. The three indices used in the standard deck are Arabic numbers 2–10; court rank: Jack, Queen, and King; and the infamous Ace which is the first card of each suit but is marked with an "A" instead of an one. In addition to the suit cards, many standard decks include one or two Jokers. In many popular card games, Jokers are considered to be wild cards and often have premium value. Although the suit-marks of a deck of cards may vary from country to country, reference to the standard deck, standard playing card deck, or standard playing cards refers to a deck of cards organized, essentially, as just described. The description shows that the standard playing card contains two basic units of information: a suit sign and an indicator of the card's value or rank. Any pictures used on the cards of the standard deck repeat or visually reinforce one or both of these basic units.

Part of the widespread popularity of the standard deck lies in its familiarity. But another part of its charm lies in its case of use. The player only has to concentrate on and distinguish between a few basic units of related information in order to use the deck. Having to utilize only a few basic units of related information enables card play to move at a relatively rapid pace. Another part of the excitement of playing cards with the standard deck lies in the rhythm of repeating a series of fixed, relatively fast paced actions, or variations of these actions. Here again having to utilize only a few units of related information contributes to enjoyment of use. Moreover, a large variety of games of chance can be played with the standard deck. The games range from those that are quite simple to those that are quite complex. Thus, another part of the widespread appeal and long term endurance of the standard deck probably lies in the versatility that is inherent to its simple overall structure.

Non-standard Playing Card Decks: Two Major Types Structurally

The primary function of the standard deck is for use in gaming. Playing card decks featuring novel designs and subject matter have also been produced, however, in large numbers. These decks are referred to as non-standard. The designs or subject matter added to the cards of the standard deck live the deck a function in addition to gaming. Pure art or fancifulness and educational subjects are two of the functions for which non-standard decks have been used most often. Over time, decks devoted to fortune telling, political satire, heraldry, religion, arithmetic, spelling, history, morality, poetry and drama, music, wars, geometry, and geography have been mass produced. Thus, a myriad of various kinds of playing card decks have been developed, over the centuries.

Despite the wide variety in the subject matter addressed by non-standard decks, they may be classified, based on whether or not they employ a suiting scheme, into two major types: suited and unsuited. Suited non-standard decks may be further classified, structurally, based on the type of suiting scheme employed, into two major sub-types: standard suited and non-standard suited decks. Standard-suited non-standard decks utilize the suit marks of the standard deck to organize the deck and structure its use. The various non-standard suited decks utilize a variety of non-standard suiting schemes to organize and structure deck use. The present invention relates to non-standard suited geography playing card decks, in general, and non-standard suited political geography playing card decks, in particular. These decks are beset by a number of problems. Before turning to analysis of these problems, however, a brief overview of the subject matter of the decks, geography, can aid in understanding these problems and, perhaps, suggest solutions for them.

The Science of Geography and Geography Playing Cards

The science of geography is generally concerned with the distribution of contemporary phenomena over the earth. Location, patterns of distribution, and arrangement of phenomena hold a place of central importance in geography. Literally, millions of phenomena are embraced by the field. This vastness makes teaching and learning geography a, somewhat, daunting task, at times. Because knowing the location of a myriad of specific places or things is prerequisite to discerning patterns of distribution or arrangement of phenomena, over the earth, maps are the major organizing tool of the geographer. Three types of maps are utilized. Reference maps are used, similar to encyclopedias, as sources of information. Illustrative maps show the distribution of specific phenomenon or the spatial correlation of two or more phenomena on the surface of the Earth. Analytical maps suggest ideas for testing.

Location: The Foundational Concept of The Science

In a sense, a map may be thought of as an organized compilation of representations of a number of different locations. All location is, however, relative to some other fixed point of reference. Thus, location, itself, is the fundamental concept of geography and the foundation of the science. Location is so important that a specialized system for locating places on the face of the Earth has been developed. This system is, of course, the grid address system formed by intersections of lines of latitude and longitude; with the equator and prime meridian being the fixed points of reference. In this systems places are located in terms of number of degrees north or south of the equator and number of degrees east or west of the prime meridian. Line intersections provide fairly precise locational information, lines of latitude and longitude are thus, point intersection locators. Degrees can be divided into sixtieths or minutes (') and any location on the planet can be described as being located at a certain number of degrees and minutes of latitude either north or south of the equator and at a certain number of degrees and minutes of longitude either east or west of the prime meridian.

The grid address system is widely utilized on globes and maps. Various cartographers utilize various increments of degrees, but 20 degree increments are most commonly used. Unfortunately, decrees of latitude and longitude vary in length, for instance, at zero degrees latitude, the length of 1 degree of latitude is 68.70 miles while the length of 1 degree of longitude is 69.17 miles. At a latitude of 50 degrees, the length of 1 degree of latitude is 69.12 miles while the length of 1 degree of longitude is 44.55 miles. At a latitude of 90 degrees, the length of 1 degree of latitude is 60.41 miles while the length of a 1 degree of longitude is zero. Moreover, prior advanced technical knowledge is required for effective use of the system as a tool for learning political geography facts and this limits the system's widespread utility as an aid to forming a picture of the general location of a political unit.

A second, less technically sophisticated, way of locating a place is to describe that place's position in relation to some other known point of reference, i.e., central, outermost, etc. Cardinal directions are also used in this regard. Distance in terms of number of miles from, meters to. etc., constitutes another way of locating a place or thing. But distance offers a number of disadvantages and limited advantages as a locational aid. A fourth way of locating a place or thing, however, is to describe it in terms of its natural setting or shape and this generates a type of landmass system for locating a place. Each of these ways aid in determining where or how something is situated relative to some fixed point of reference and, hence, are referred to herein as "locators."

There are, of course, a number of branches or subfields in the science of geography. The three major subfields are: physical geography; biotic geography; and human geography. Human geography includes political geography, social geography, cultural geography, urban geography, economic geography, rural geography, settlement geography, geography of religions, geography of languages geography of factories and types of manufacturing, geography of political boundaries, and so forth. Cultural geography emphasizes the distribution of patterns in human ways of being or living. Political geography is a branch of topical geography that emphasizes the distribution of patterns in the Earth's political sovereignties, units, or countries.

This brief overview suggests that geography is a vast field of intellectual endeavor and this means that, theoretically, an almost infinite variety of geography playing card decks are possible. This vastness and variety provide the context for understanding geography playing card deck development.

Geography Playing Card Decks

The first deck of geography cards is said to have been produced in Nuremberg, Germany in 1640 A.D. (Tilley: 1973). This first deck was followed by the famous, Le Jeu de la Geographie, produced in France in 1643 for a young, academic disinterested, Louis XIV. These two decks were followed by a flood of geography playing card decks, with over 50 different types of decks being produced detailing the following, century. Ingenious ways were found to superimpose geographical information onto the cards of the standard deck. The vast majority of the decks would devote one suit of the standard deck to one of four continents. The physical geographical information framework of "continent" would then be used to provide varying units of human geographical information. Most of the decks used political geography as a proxy for culture with cultural geography information dominating the cards of the standard deck. Thus in most of the decks, emphasis is on teaching about cultural variety as opposed to teaching about political geography, per se.

In the typical European model, one of the standard suits is devoted to one continent with each card providing a variety of information about one country of the continent. The Winstanley Geography Card Deck, Four Parts of the World (England, 1675) is a prominent example. The Winstanley cards gives information on dress or costumes of countries; "habits and fruitfulness" of the people of the lands; describes the general location of the continent, textually and gives the general location numerically, as well, using lines of latitude and longitude; and provides a brief historical overview of the country and continent.

Passive Learning Theory of Standard Suited Geography Playing Card Decks

Although adding, varying kinds and amounts of geographical information to cards, inventors using the standard deck to convey geographical information, are, in essence, subscribing to a passive theory of learning. The assumption of the theory is that repeated use of standard suited geography playing cards for say, a game of poker or rummy, will result in passive learning. That is, repetitive exposure to geographical information on the front or back side of the cards will cause the player to notice, remember, or "learn" the information. All standard suited geography playing card decks follow the basic format of adding units of geographical information, including pictures and/or maps, to the cards of the standard deck.

Theoretical and Practical Problems

A major problem with the standard suited geography playing card approach, however, is that it combines geographical information with standard suit markings. The two sets of information are unrelated and the combination is unproductive, educationally. That is, despite the presence of geographical information on the cards, the information actually needed and used to play, say a game of poker or Rummy, is the information provided by standard suit markings and this information is not at all related to the geographical information contained on the card.

A related problem stems from the fact that the fun and excitement of most card combination card games lies in the challenge of making the spread. As such, during game play, player attention is directed to acquiring the cards, bearing the standard suit marks, that will help him in developing the desired combination of cards. Attention is not necessarily on the geographical information contained on the card. Now, given scenarios of either no exposure to geographical information during card play or some exposure to geographical information during game play, some exposure may be preferable to none. Even so, the presence of standard suit markings actually directs player attention away from the geographical information contained on the card. Thus, standard suited geography playing cards are not very efficient instruments for learning about geography.

A related difficulty lies in the fact that the combination of geographical information with standard suit markings, with reliance on standard suited markings for game play, tends to diminish excitement and interest in geography on its own terms. The informational value of the geographical information on the cards not only seems quite dull, but actually has no value, in the context of a playing a standard game of Poker or Rummy using a standard suited deck. In contrast, the informational value of standard suit markings, during card play, is extremely high. Thus, the standard suited approach establishes two classes of information, information used for the fun of play and information that the player might find interesting when the player is not engaged in actual play of the game. The implication is that learning, per se, is not fun. Therefore, the approach tends to foster and perpetuate a less than positive player attitude toward learning, in general, and geographical knowledge, in particular, if the geographical information is noticed at all. This suggests that the standard suited approach to geography playing cards is not only an inefficient instrument for teaching/learning, political geography facts but may also be counterproductive relative to fostering positive attitudes toward learning, in general, and geography, in particular.

In addition fairly large amounts of predominantly cultural and economic information are condensed to flit the space constraints of the cards. Political geography facts are given short shrift, overshadowed by the relatively large amounts of information on the cards. But even where cards contain smaller amounts of geographical information, the unrelatedness, diminutive, and player distraction issues discussed above are not overcome.

Finally, a number of standard suited geography playing card decks use geographical information to amuse players as a further enticement to deck purchase. Unfortunately, the amusement value is frequently obtained at the expense of valuing teaching/learning about political geography facts, as valuable in their own right. This further exacerbates the aforementioned problems.

An Alternative Model For Geography Playing Card Decks

The above critique suggests that from an educational perspective, the ideal geography playing card would not contain any standard suit markings at all. The ideal geography playing card would, instead, be suited on fundamental geographical concepts. Suiting on geographical concepts provides card users with clear focus and structured framework for further learning and study. Moreover, the cards of the ideal deck would only bear a few units of related geographical information. The units of information, contained on the cards, would serve as the elements of the larger concept being represented by the suit. Ideally, the units of information would be adequate to play adaptations of a number of popular card-combination games. Thus, in the ideal deck, cards would bear only needed, or reinforcing units of information that facilitate the adaptation to the play of popular card games.

When the geographical data contained on the playing card is the information that is needed to, say make a spread in a card-combination game, or reinforces the information needed to make the spread; player attention is redirected from standard suit-markings and card values and the player is forced to focus directly on the geographical information on the card. Player exposure to geographical information is thereby maximized because the player is using the information in order to play the card game. This is extremely conducive to learning. But, such a deck is not easy to construct.

Even so, a few such non-standard decks have been invented that reflect this approach, more or less. Such decks have been suited on location, or more specifically, directional locators. The decks appear to aim to teach bind serve as globe or map locational aids. Unfortunately these decks have failed the long-term endurance test, passed with flying colors, by the standard deck. Understanding the strengths, weaknesses, and problems associated with such decks may be instructive. Attention now turns to these inventions.

Early Locational Suited Geography Playing Card Decks

In 1770, a locational aid type of geography playing card deck Giuaco Geogrtfaco dell 'Europe (Geografico) was released in Italy. Geografico is the first date-documented deck of directional suited geography playing cards. The last major group of suits in the Maj Jong Card Decks of China is called the Four Winds Group which has suits: North, South, East, and West. There are four or five cards in each of the Four Winds suits. Although Maj Jong Cards are known to be very old, the exact date for the invention of the Sour Winds suit is unclear (Wowk, 1983:120). Because the Four Winds suits are not structured to be locational aids, analysis herein is focused on Geografico.

Giuaco Geografico dell 'Europe

In (Geografico, the deck represents the Continent of Europe. Suits represent regional divisions of Europe. Cards represent the major kingdoms located within the region being represented by the suit. Suit names are "Nord, Sud, Centro, and Isole." The suit names serve as locators for the kingdoms but deck structure emulates the 52-card, 4-suit, 13 cards per suit structure of the standard deck. Suit cards are numbered sequentially from 1 to 13.

Invented 130 years after the first deck of geography cards, Geogrcafico is the first truly political geography card deck. Deck elements, suiting scheme, and naming convention suggest that the object of the deck was to teach fundamental political geography. The emulation of the structure of the standard deck suggests that another object was to provide a deck of political geography cards that could be readily adapted to the play of card games normally played with the standard deck. There are several problems with the deck, however. To capture Geografico's problems, adequately, requires reconsideration of the role of locators.

The Ideal Locators

In addition to locating a thing by its directional position, it is also, of course, possible to locate a place or thing using the locators discussed earlier. Geografico illustrates the use of multiple types of locators in its use of the position locator "central" and type of landmass locator, "island." What the locator does is to assist in ferreting out or spotting the thing or identifying a thing. The locator does this by providing some sort of clue about the thing's distinguishing features or how the thing is situated relative to something else. The ideal locator is, of course, parsimonious but descriptively precise as possible. The ideal locator for suiting geography card decks will build on existing user knowledge levels as well. In reality, however, there will be some sort of trade-off and finding the "right" balance and blend of locators has been part of the difficulty in developing locator suits for geography playing cards.

Geografico's Locators

Geografico can be described as multifaceted in terms of the number and type of locators utilized. But, its single most dominant feature is a terse one-term naming convention. The naming convention is a reflection of the underlying suit configuration scheme. Geografico's directional suits are configured on the cardinal points of the compass, only; and therefore, Geografico is constrained to four compass points or only one facet of direction, the cardinal directions. Thus, although suit names reflect that the underlying suit configuration is a mix of three different facets of location, direction, position, and type of landmass, Geografico's most dominant feature is its use of an extremely concise, uni-faceted naming convention. This uni-faceted naming system severely compromises the overall informational value of the deck because the uni-faceted naming system severely constrains the descriptive value of the directional suits as conveyors of locational information. Moreover, even though three different facets of location are described (direction, position, and landmass type) these locators are also single faceted. Thus, the most apt description of the deck is that it is dominated by a uni-faceted suit configuration and suit naming convention.

Another problem for Geografico's is that its overall size is insufficient to devote a card to each major political unit of its day. In other words, the inventor was forced to rearrange and/or exclude some of the major political units of his day, in order to accommodate the four-suit, 13-card per suit, 52 card structure of the standard deck. This forcing may explain why at least one critic commented that the deck "moved" one kingdom from Ireland to Scotland.

A third and final observation about Geogiafico is that it is difficult to discern a unifying, theme the underlying, the assignment of the value to the cards. Simply numbering the cards from 1–13 as a way of imitating the structure of the standard deck, is also a type of forcing. The assignment of values in the standard deck is thought to be representative of the social structure of its day. Therefore, at the time of the standard deck's introduction, a readily understood, generally agreed upon, and fairly well accepted theme underlay the assigning of higher rank or value to some cards of the deck. The value assignment scheme had a meaning that was readily understood and acknowledged by almost all card users. But, how does citizen A of the kingdom assigned to card No. 2 relate to Geografico? Suppose citizen A rates his/her kingdom as being superior to all of the kingdoms assigned to cards Number 3 through 10? The point here is that assigning fixed values or ranks to cards representing political units has the potential to create some very thorny problems.

Despite these weaknesses, however, from a geographical education perspective, Geogrcqfico has three major strengths. First, Geografico is the first truly location-based geography playing card deck that suits the cards of the deck predominantly on directional locators. The suiting scheme also transforms the cards of the deck into educational aids that teach political geograplhyfacts in a fairly straightforward manner. Second, the deck uses a large landmass as a point of reference (the Continent of Europe). Third, Geografico attempts to employ the suiting scheme that would seem to be a "natural" one for a deck of geography playing cards. Unfortunately, effectively implementing this "natural" scheme proves to be a feat that is too difficult for Geografico to accomplish.

Non-Standard Suited U.S. Patented Geography Playing Card Decks

With these observations in mind, attention now turns to a more cursory examination of five non-standard suited geography playing card decks covered under U.S. issued patents. In the U.S., the first patent for a deck of geography playing cards issued in 1876. Between the issuance of the first patent and December, 1996; about 35 or so U.S. patents covering playing cards containing geographical information have issued. Of the 35 or so patents, only the five examined herein are non-standard suited decks. Of particular interest about each of the five decks is what is being suited; how the suiting is achieved, whether and/or how a value or ranking is assigned to the cards, and the suit naming convention employed for card use.

Miller (1924, U.S. Pat. No. 1,489,541) suits on the stops of a geographic travel route. Miller's focus, however, is on distance in terms of miles. Thus, Miller's deck is excluded from further analysis.

Branch (1918, U.S. Pat. No. 1,273,024) seems to suit on sections of the United States. Branch never explicitly states this suiting, however. Rather, Branch tells the reader that his suit symbols are red marks, white marks, blue marks, stars, and stripes and that these symbols correspond to point numbers on the cards.

In addition to 28 other units of information, Branch uses either a directional or name of place landmass locator on his game cards. The cards are "inscribed with the name of a political division, a word indicating the section in which said political division is located, and also a number indicating the relative rank of said political division and also indicating the point value of said card, said number being distinctive in appearance and said card also having a suit symbol which corresponds with the distinctively indicated point number." The directional and name of landmass locators used by Branch are: "Southern, New England, Central, Northern, and Western" as the "word" indicating) the section of the United States to which the political division belonged. Branch also provides the names of the states or political divisions bordering the state or political division represented by his card and uses directional locators of "n, s, e, and w" to indicate the relative position of the states or political divisions bordering the state represented by his game card.

Higgins (1905, U.S. Pat. No. 787,295) groups his pack of U.S. Presidential Election cards by dividing "the forty-five States . . . into four groups, the groups being designated 'North,' South,' 'East,' and 'West,' and each group . . . printed in a different color from the others . . . wherein . . . a red card indicating the 'East' group . . . blue, indicating the 'West' group; green, indicating the 'North' group; and . . . purple, indicating the 'South' group. Although grouping on direction, Higgins suits on the States because his interest is in counting electoral college votes. Color coding his cards, to indicate to which group a suit belongs, Higgins' cards bear the name of one of the 45 States, names of 4 cities in that state, and the number of electoral college votes to which the State is entitled. Higgins' limits the units of information on his cards to six units and thus, the cards do not overwhelm would be users with information.

Dealy (1887, U.S. Pat. No. 357,184) suits his U.S. Politics Deck of cards on the four leading political parties contending in the Presidential election of 1884. Each card represents a U.S. State. Dealy provides between 3–17 units of information about the State's electoral politics on each card but otherwise ignores location and direction. Thus. Dealy's deck is also being excluded from further analysis.

Read (1880, U.S. Pat. No. 229,914) suits his U.S. Geography Cards "by means of parallels of latitude" and then uses lines of Longitude to subdivide the cards into smaller groups. More specifically Read says that the suits of his deck were "designated by the line of latitude passing through or near the States or Territories in that suit." He states further that he then divided the cards "into groups which are distinguished by the different lines of longitude which passes over or near the State or Territory." The names of the states comprising the smaller group are given on the card in addition to 12 other units of information. A map of the state of interest is provided which shows the states bordering the state of interest, as well. The value or rank of the card in any one suit is determined by the population of the state represented by the card.

The only indication of the use of direction on Read's cards is a "W," on the drawing. In fact, no suit names of any sort are provided for use in play. The number of the line of longitude that links the three other states of the smaller groups is placed top-center of the card. The number "260"

is given. Read's method is not very helpful for a number of reasons. Ignoring that most maps and globes give longitude in terms of 1–180 degrees east or west of the prime meridian, the number does not readily aid the card user in impression formation or in the formation of a picture of the general location of a specific political subdivision or area such as the State of Ohio. Moreover, Read only uses two lines to configure his suits. The deck would have benefited from the use of four lines, two longitudes and two latitudes in order to form general areas. If Read had employed four lines instead of two, the method would have yielded fairly contiguous blocks or land areas that could be more easily located on a map or globe. The fact that his method yields a group of States comprised of Ohio South Carolina, North Carolina, and Kentucky, only adds to a general state of confusion.

Non-suited U. S. Patented Decks Containing Directional and/or Locational Information A number of the non-suited geography card decks also provide directional and/or locational information on their cards. How this information is organized and presented provides a further indication of the need for the present invention.

Wells (1919: U.S. Pat. No. 1,292,184) uses the cards in his. Geography Card Game, deck to represent U.S. States. Each card represents one state and shows a map of the state along with the states that border the state of interest.

Scholz (1918: U.S. Pat. No. 1,269,320) uses the cards of his deck to represent different political divisions. Each card contains a map and the name of one of the political divisions or the name of a body of water contiguous to a plurality of the other political divisions or bodies of water, the names of all contiguous political divisions or bodies of water, the population of the political division represented, a simple number denoting points based on the population of the political division represented or arbitrary assignment of points for the bodies of water. The cards also show the names of the contiguous political divisions and bodies of water, with their general direction, relative to the political division of interest, indicated by directional locator terms "north, east, south, west."

Tercy (1915: U.S. Pat. No. 1,123,622) also uses the cards of his deck to represent U.S. States. Each card represents a state and has the names of bordering states in the margins of the card. The names of the bordering states are placed on the card margins corresponding to the directional position of the border state, i.e. the top margin contains the name of the state or states that on the are north border of the state represented by the card.

Wade (1905: U.S. Pat. No. 791,118) uses a set of leading cards which represent a geographical division of a country and contains data pertaining to the geographical division. A set of switch cards is also used. Some of the switch cards represent a boundary of the country and some represent a river of the country. The switch cards also contain data pertaining to such boundary or river.

McGeorge and Batiks (1893: U.S. Pat. No. 506,648) also use their card deck to represent a country. Each card has the name of the states or territories of the country represented by the card. The area of the state is given in square miles. The state's population and number of counties are also given. The names of all adjoining or contiguous states, or those which bound the state are also placed on card margins in positions that correspond to the true general directional position of the boundary state.

The Quest For Locational Suits

Over time, the four cardinal directions of the compass have been found to be fairly good locators, or pointers. These simple directions arc also widely known and understood. This is why directional suiting seems to be such a natural for geography playing cards. But, besides the four cardinal points of the compass a first division of each of the cardinal points produces the inter-cardinal points. A division of the inter-cardinal points produces the intermediate points of the compass and a division of the intermediate points produces a fourth set of points for a total of thirty-two points of the compass in all. Thus, direction has a number of facets. This review has found no evidence, however, of the use of any of these additional facets of direction to suit a deck of geography playing cards. Why this is so can't be known for sure because these points were widely used and well known for many centuries prior to the invention of Geografico.

Conclusions About the State of the Art in Geography Playing Cards

This review of the state of the art in the field of geography playing cards suggests that, in general, a number of gaps exist in the field. Relative to locational suited geography playing cards, the U.S. Patent Record suggests that only unifaceted directional suited card decks have been invented and this single facet is reflected in the suit naming conventions used by the inventors who have attempted location-based suiting.

Location-Suited Decks

Read (1880) uses a locational suiting scheme based on point intersections of parallels of latitude and lines of longitude and then imposes a unifaceted naming convention onto the system. The organizational value of the point intersections as a method for configuring suits proved to be inadequate. For example the method resulted in a suit group comprised of Ohio, W. Virginia, North Carolina, and South Carolina. The inadequacy of Read's method is rendered even acute by Read's attempt to use lines of longitude numbers in lieu of a suit naming convention. This attempt requires users to have a thorough grounding in, or study of, the grid address system before being able to enjoy using the cards. This places the deck out of reach for far too many potential users.

Higgins (1905) employs a unifaceted directional scheme to group the suits of his deck but avoids the suiting on location problem by relying instead on a color coding scheme to distinguish between his groups and by suiting on States, instead. With each of his 45 State suits being comprised of four cards each. The Higgins deck of 1905 had a total of 180 cards. If produced to accurately reflect today's Federal Union, the deck would now have a total of 200 cards!

Branch (1918) provides unifaceted directional information on his cards, and may have even suited by the single facet, but Branch superimposes a patriotic suit symbol convention onto his unitaceted directional suiting scheme. This obfuscates the locational value of the suiting scheme because the symbols used lack the descriptive value to sustain them as locators of sections of the Branch (1918), Higgins (1905) and Read (1880) all actively assign fixed values to each of their cards. Higgins assigns card value based on the number of electoral votes to which a State is entitled; while. Branch and Read assign card value based on a State's population. Higgins' method of assigning, value to cards is limited in its application, however, to only those countries which have an electoral college system of some sort.

Non-Suited Decks

Examination of non-suited geography playing cards containing subdivisions of geographical areas and/or referencing direction has also been instructive. The examination shows that there is a relatively widespread tendency in the field to use maps as a substitute for suiting language. The maps show bordering political units in their directional location to the political unit of interest. Another technique employed is the provision of a list of the names of bordering political units while using the abbreviations "n, s, e, and w," to indicate the directional location of these bordering political units relative to the political unit of interest has been identified. These efforts are indicative of the need for a predominantly directional, locator based suiting scheme for geography playing cards.

Need For A Viable Locator Suiting Scheme and Naming Convention

The above practices express inventor's efforts to locate the areas of interest within some larger, but intermediate locational system. That is, inventors have intuitively understood that some sort of intermediate point of reference needs to be conveyed to card users. Unfortunately for the art and considering the high level of creativity demonstrated in that art, how to develop and implement a language based locational suiting system in geography playing card decks is not very apparent.

Part of the difficulty lies in boundaries of political units that do not easily form neat horizontal and vertical lines and do not line up in neat horizontal rows and column. In other words. The landmass areas occupied by various political units vary widely in shape and size as does the number of political units located in one general area. These conditions help to explain why most geography playing card deck inventors have foregone the non-standard suiting effort completely. That is, over time, most inventors have relied on the structure of the standard playing card deck for a broad organizational structure thereby avoiding the suiting on location problem. A few inventors have attempted to institute a locational or directional suiting scheme. However, these schemes relied on the cardinal points of the compass, only tapping only one major facet of direction, the cardinal directions.

Thus, directional locators used in Geografico's, Branch's, and Higgins' decks arc all constructed too narrowly. (Ggeoografico's suits are named too narrowly, as well. Branch fails to institute a suit naming convention, at all. Read's application of earth grid address locators results in locator suits that are too technical and uninformative and his suits are also left, essentially unnamed. Further, the cards of almost all decks examined evoke a sense of information overload. Thus, no effective method for locational suit configuration and no effective suit naming convention had been deployed in political geography playing cards as of December, 1996.

Technological advances in communication and transportation as well as the advent and hegemony of a global economy, make firmer grounding in political geography facts a necessity for today's citizenry. Absence of viable suiting and suit naming mechanisms, however, precludes popular use of geography playing cards as serious educational and entertainment tools, leaving a large void in this field of art.

The present invention fills this void through a novel combination of a number of different techniques. Application of these techniques result in development of the first effective locator suits for geography playing cards. The suit configurations, suit naming convention, system for assigning card values, suit sizes, and overall organizational structure resulting from application of this novel combination are all about, just right.

BRIEF SUMMARY OF THE INVENTION

The present invention comprises a method for teaching/learning about the general location of the major political units of contemporary society. The method is applied to a series of sets of geography playing card decks. The object of the invention is to provide an enjoyable, easy to use, method for teaching and learning about the political geography of contemporary society. Each set of decks comprises a World Regions Card Deck. Country Card Decks, and a Blotswanna Card Deck. The World Regions Card Deck and the Suited Country Card Decks are main informational decks. Two card play utility decks. The Blotswanna Card Deck and the Unsuited Country Card Deck complete the set of decks of the invention.

Advantages of the Invention

The invention ameliorates a number of the problems associated with traditional non-standard suited geography playing card decks and offers a number of other advantages as well. The invention provides a method for locator suit development that is a major advance over traditional locator suit development methods. Locator suit configuration possibilities have been significantly increased by expanding directional locators to include the intercardinal points of the compass. The learning and card game play utility of locator suits has been significantly increased through the institution of a suit naming, convention which results in locator suit names that are much more descriptive, of the location being represented by the suit, than the suit names of traditional locator playing card decks. The information overload problem in geography playing cards is alleviated by the use of multiple decks of increasing difficulty. Only related geographical information is included on the cards. The set of decks is structured for gradual learning of political geographical facts through active use of card information in the play of card games. Use of region specific place-filler cards in locator suits enables the suits of a deck to have an identical number of cards thereby facilitating the use of decks to play a number of traditional card-combination games. Use of region specific Country Wild Cards as place-filler cards, in the Unsuited Country Card Decks, allows for an extremely challenging level of card play but within the basic locational knowledge framework gained from use of the World Regions Card Deck and the Suited Country Card Deck. Fixed card values are replaced with a variable card value system. The system for assigning card values also adds to the fun and excitement of use of the informational decks. A game, Bop About the World, illustrates an adaption of the rules of a rummy card game for use with the decks of the invention.

Overview of Invention Structure, Elements, Linkages, and Methods

The World Regions Card Deck represents the planet Earth and introduces users to the general locations of geographic divisions or regions of six major continental landmass areas. Each of six Suited Country Card Decks represents one of the six continental landmass areas. Suited Country Card Decks introduce users to the names of major political units or countries, or places, or things located within the regions of a particular continental landmass area. Suit cards provide users with a regional context for locating the country or political unit, or place, or thing, via inclusion of a regional suit name on each suit card. Each of the six Unsuited Country Card Decks also represents one of the six continental landmass areas. Unsuited country cards provide users with opportunities to assess the progress of their learning and facilitate tournament style play because the cards of the unsuited decks do not bear a region suit name. A Blotswanna Card Deck structures learning and heightens excitement of use of World Regions and Country Card decks. Blotswanna cards mandate player compilation of a particular combination of cards, from the World Regions or Country Card Decks, and assign varying point values to mandate achievement, from hand-to-hand of play.

Common locator-suit and region names, descriptive of regions' general locations, plainly link the World Regions. Country Card and Blotswanna Card decks. Common names also provide the framework within which players acquire working knowledge about the general location of geographical regions of a major continental landmass area or groupings of landmass areas. Players have the option of playing simple card-matching games with the World Regions Card Deck or using the Blotswanna Card Deck to structure play of more complicated games. Even more complicated card-combination games are played with Country Card Decks and their companion Blotswanna Card Deck. Card play with suited Country Card Decks leads players to an increasing familiarity with the names of political units located within the regions of a continental landmass area or (grouping of landmass areas, thereby building on the information learned from use of the World Regions Card Deck. Playing the same, more complicated card-combination games with the unsuited Country Card Deck constitutes an interesting and exciting test of players' knowledge about the general location of major political units or countries.

Invention Decks and Deck Cards

Each deck has a plurality of cards. World Regions and Suited Country Card decks have a plurality of suits and plurality of suit cards. The World Regions Card Deck and the Country Card Decks may further include one or more Wild Cards. Cards of each deck have a backside and a front side. The backsides of the cards of a deck are visually-similar.

World Regions Card Deck suits represent one continental landmass area. The designated suit name is the traditional name for the continental landmass area represented by the suit. Each continental landmass area suit is divided into a plurality of smaller areas or regions. Each suit card represents one of the smaller areas or regions. One or more of the smaller areas or regions of a continental landmass area suit is configured by means of the inter-cardinal points of the compass, or by means of one or more position locator, or by means of one or more type of landmass locator. Locators are used singly, or in combination. Region names are descriptive of the region's general location by means of inclusion of directional and/or, positional and/or type of landmass locator terms and the continental landmass area name; in the name designated for the region. There are identical pairs of cards for each region. World Region Card Deck card front sides bear a continental landmass area suit name and a region name.

Each of six Suited Country Card Decks represents one of the six major continental landmass areas or grouping of landmass areas. Each suit of these decks represents one of the regions of the continental area being represented by the deck. The designated suit names of a deck are identical to the region card names of the continental landmass area suits of the World Regions Card Deck. Suit cards are comprised of country cards and regional cards. Each country card represents one major political unit located within the region represented by the suit. Regional cards are used as place-filler cards in the suits of these decks. A region card may be defined or undefined. A detailed region card is a place-tiller card that represents either a particular place that is located within the geographical region being represented by the region card or a particular thing that is located within the geographical region being represented by the region card. An undefined region card is a place-filler card that represents the overall geographical region that is being represented by the region card. Deck suits have identical numbers of cards. Decks may also include one or more Continent Wild Cards. Continent Wild Cards represent the continental landmass area, overall. Suited country card front sides bear the suit name and the name of a major political unit. Defined Regional Card front sides bear the suit name, a regional card designation and the name of a particular place or thing located within the region. Undefined Regional Card front sides bear the suit name and a regional card designation but do not define a particular place or thing. Continent Wild Card front sides bear the continental landmass area name and a wild card designation.

The Unsuited Country Card Deck comprises a plurality of cards and represents the countries of the continental landmass area being represented by the deck. The cards of the deck comprise country cards, country wild cards and continent wild cards. Each country card represents one major political unit located within a region. Country wild cards are used as place-filler cards in the unsuited Country Card Deck. Each country wild card represents one known or unknown ancient community or kingdom that was located within the instant country's larger region. Continent wild cards represent the continent area, overall. Unsuited country card front sides bear the name of a major political unit. Country wild card front sides bear a region name and country wild card designation. Continent wild card front sides bear the continental landmass area name and a wild card designation.

Blotswanna Card Deck front sides bear a mandate for compilation of a particular combination of cards and assign point values to the compiled cards for a particular hand of play. Mandates are type of deck neutral in that Blotswanna cards for a particular landmass area can be used to structure play for any of the above three decks.

Although not strictly required cards of a deck may also bear appropriate maps or map outlines. Instructions for the card-combination game, BOP About the World, are also included.

DETAILED DESCRIPTION OF THE INVENTION

Figure 1:
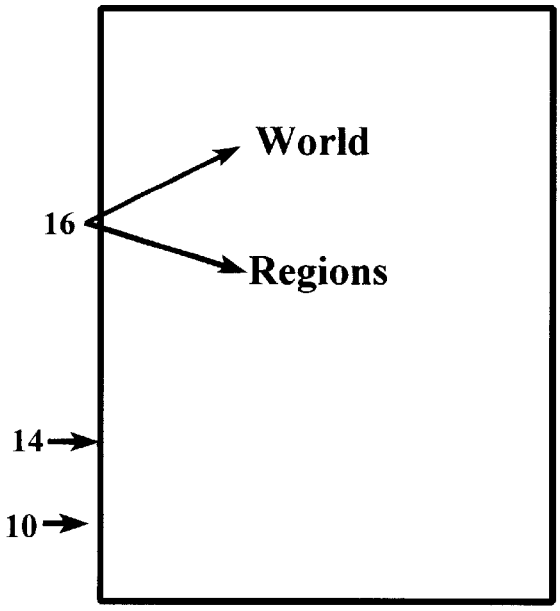
FIG. 1 shows the common back side of all cards in the Region Card Deck

This invention comprises a method for teaching/learning about the general location of the major political units of contemporary society. A series of sets of decks of geography playing cards are used to introduce the learned to the general location of selected regions of the world and the names of the major political units or countries located within those regions. Collectively the regions cover the landmass areas or grouping of landmass areas of the continental areas of Africa, the Americas, Antarctica, Asia, Europe, and Oceania. The decks of a set are tightly linked. Each set of decks comprises two main informational decks. The World Regions Card Deck and a locational Suited Country Card Deck. Two card play utility decks, The Blotswanna Card Deck and the Unsuited Country Card Deck complete each set of decks of the invention.

An overview of invention structures, elements linkages and methods will enhance understanding of invention mechanisms and is presented in the following section. This is followed by presentation and description of drawings which illustrate a few of the typical cards from the invention. A detailed description of a card-combination game developed for use with the invention, BOP About tile World then follows.

Overview of Table 1. Structure of Main Informational Card Decks

The structure of the main informational decks is best displayed in tabular format as shown in Table 1. Structure of Main Informational Card Decks. This table clarifies the elements and overall structure of the World Regions and Suited Country Card Decks and highlights the tight linkage between the two decks. The structure of these two decks captures the essence of the inventions method. It can be seen that Column 1 of the table has two column labels.

The first label. Continental Landmass Areas Suits and Region Cards of the World Regions Card Deck guides interpretation of column 1 data in the context of the World Regions Card Deck. Column 7 of table 1, World Regions Deck, Total World Regions Cards, completes the World Regions Card Deck information provided in Column 1.

The second Column 1 label, Landmass Areas and Regional Suit Names for Suited Country

TABLE 1

Structure of Main Informational Decks

| Continental Landmass Area Suits and Region Cards of World Regions Card Deck | Suited Country Card Decks | | | | | World Regions Card Deck |
|---|---|---|---|---|---|---|
| And | Total Number of: | | | Total | | Total World |
| Landmass Areas and Regional Suit Names For Suited Country Card Decks | Country Cards | Region Cards | Suit Cards | Wild Cards | In Country Card Decks | Regions Cards |
| African Landmass Area | 57 | 21 | 78 | 6 | 84 | 12 |
| Northern Africa Coastline | 12 | 1 | 13 | | | 2 |
| Southeast Africa Coastline | 10 | 3 | 13 | | | 2 |
| West Africa Coastline | 12 | 1 | 13 | | | 2 |
| Southwest African Coastline | 8 | 5 | 13 | | | 2 |
| Inland North Africa | 6 | 7 | 13 | | | 2 |
| Inland Southern Africa | 9 | 4 | 13 | | | 2 |
| Americas Landmass Area | 49 | 29 | 78 | 6 | 84 | 12 |
| Northern Americas | 6 | 7 | 13 | | | 2 |
| Central Americas-west | 7 | 6 | 13 | | | 2 |
| Central Americas-central | 11 | 2 | 13 | | | 2 |
| Central Americas-east | 11 | 2 | 13 | | | 2 |
| Northern South Americas | 6 | 7 | 13 | | | 2 |
| Southern South Americas | 8 | 5 | 13 | | | 2 |
| Asian Landmass Area | 46 | 19 | 65 | 5 | 70 | 10 |
| Northeast Asia | 3 | 10 | 13 | | | 2 |
| Southeast Asia | 12 | 1 | 13 | | | 2 |
| Central Asia-east | 9 | 4 | 13 | | | 2 |
| Central Asia-west | 9 | 4 | 13 | | | 2 |
| Western Asia | 12 | 1 | 13 | | | 2 |
| European Landmass Area | 48 | 17 | 65 | 5 | 70 | 10 |
| Northern Europe | 4 | 9 | 13 | | | 2 |
| Eastern Europe | 9 | 4 | 13 | | | 2 |
| Central Europe-east | 11 | 2 | 13 | | | 2 |
| Central Europe-west | 13 | 0 | 13 | | | 2 |
| Western Europe | 11 | 2 | 13 | | | 2 |
| Oceanian Landmass Area | 29 | 23 | 52 | 4 | 56 | 8 |
| Eastern Hemisphere Oceania-north | 5 | 8 | 13 | | | 2 |
| Western Hemisphere Oceania | 1 | 2 | 13 | | | 2 |
| Eastern Hemisphere Oceania-central | 4 | 9 | 13 | | | 2 |
| Eastern Hemisphere Oceania-south | 9 | 4 | 13 | | | 2 |
| Antarctica | — | 52 | 52 | 4 | 56 | 8 |
| Eastern Antarctica | — | 13 | 13 | | | 2 |
| Eastern Central-Antarctica | — | 13 | 13 | | | 2 |
| Western Central-Antarctica | — | 13 | 13 | | | 2 |

TABLE 1-continued

| Structure of Main Informational Decks | | | | | | |
|---|---|---|---|---|---|---|
| Continental Landmass Area Suits and Region Cards of World Regions Card Deck | Suited Country Card Decks | | | | | World Regions Card Deck |
| And | Total Number of: | | | Total | | Total World |
| Landmass Areas and Regional Suit Names For Suited Country Card Decks | Country Cards | Region Cards | Suit Cards | Wild Cards | In Country Card Decks | Regions Cards |
| Western Antarctica | — | 13 | 13 | | | 2 |
| World Regions Card Deck Wild Cards | | | | 2 | | 2 |
| North Pole Wild Card | | | | | | |
| South Pole Wild Card | | | | | | |
| Total Cards in World Regions Card Deck | | | | | | 62 |

Card Decks, guides interpretation of Column 1 data in the context of Suited Country Card Decks. Columns 2–6 of Table 1 complete the Suited Country Card Deck information provided in Column 1. Description of the main informational decks begins with the World Regions Card Deck. After completing the description of the World Regions Card Deck, the Suited Country Card Deck will be described.

Overview of The World Regions Card Deck Structure

The World Regions Card Deck comprises a plurality of continental landmass area suits, a plurality of region cards and a plurality of wild cards. Column 1 lists the names of the continental landmass area suits, of the World Regions Card Deck in bold text. The cards of each continental landmass area suit are region curds. The names of the region cards comprising the continental landmass area suit are nested within this column under their respective continental landmass areas. Each region card of the World Regions Card Deck represents one of the 30 regions listed in Column 1. The last section of Column 1 lists the names of wild cards that may be included in the World Regions Deck. Column 7 shows the type and number of cards in the World Regions Card Deck.

Elements of the World Regions Card Deck

The first major entry in Column 1 is for the African Landmass Area. The African landmass area is one of the six continental landmass area suits of the World Regions Card Deck. Column 1 also shows that the African Landmass Area has been divided into six regions: Northern Africa Coastline, Southeast Africa Coastline, West Africa Coastline, Southwest Africa Coastline, Inland Northern Africa. and Inland Southern Africa. Column 7 shows that the African continental landmass area suit has a total of twelve regional cards. This is because there are two identical cards for each of the six regions into which the continental landmass area has been divided.

The second major entry in Column 1 is for the Americas Landmass Area. The Americas landmass area is the second of the six continental landmass area suits of the World Regions Card Deck. Column 1 also shows that the Americas Landmass Area has been divided into six regions: Northern Americas. Central Americas-west, Central Americas-central, Central Americas-east, Northern South Americas, and Southern South Americas. Column 7 shows that the Americas continental landmass area suit has a total of twelve regional cards. This is because there are two identical cards for each of the six regions.

Reading Columns 1 and 7, in this manner, for the remaining four continental landmass areas, listed in Column 1, reveals the essential elements and structure of the World Regions Deck. Wild Cards are an optional embellishment of this essential structure. Two suggested Wild Cards, are one North Pole Wild Card and one South Pole Wild Card. With this embellishment added, the last section of Column 1 shows the suggested Wild Cards. Reading across from the last section in Column 1 to Column 7, it can be seen that the World Regions Card Deck has a total of 62 cards. Two identical cards for each of the 30 regions listed in Column 1, and the two Wild Cards.

Overview of the Structure of Suited Country Card Decks

The names of the regional cards of the World Regions Card Deck are used as suit names for the suited country card decks. That is, the Continental Landmass Area Suits of the World Regions Card Deck become separate decks of suited Country Cards at the next level of the invention. The regional cards of the World Regions Deck become the suits of the separate decks. Column 2–5 shows the type and number of cards in each of the six suited Country Card Decks. Column 6 gives the total number of cards in each of the six suited country card decks.

Elements of Suited Country Card Decks

Thus, Column 1 shows that the African Landmass Area Deck is divided into 6 suits of cards: Northern Africa Coastline, Southeast Africa Coastline, West Africa Coastline, Southwest Africa Coastline. Inland North Africa, and Inland South Africa. Column 2 shows that a total of 57 country or major political unit cards comprise the 6 suits of the African Landmass Area Deck. Column 3 shows that a total of 21 regional place-filler cards are used in the African Landmass Area Deck, for a total (Column 4) of 78 suit cards in all. Column 5 shows that 6 Continent Wild Cards are used in the deck, for a grand total of 84 cards in the African Landmass Area Deck.

Columns 1–6 of Table 1 illuminate the elements and structure of suited Country Card Decks. It can be seen that the Northern Africa Coastline Regional Suit contains 12 (Column 2) country cards and 1 (Column 3) regional card, for a total of 13 suit cards in all for the Northern Africa Coastline Regional Suit. The Southeast Africa Coastline suit contains 10 (Column 2) country cards and 3 (Column 3) region cards for a total of 13 suit cards in all for the Southeast Africa Coastline suit. The West Africa Coastline suit contains 12 (Column 2) country cards and 1 (Column 3) region card for a total of 13 suit cards. The Southwest African Coastline suit contains 8 (Column 2) country cards and 5 (Column 3) region cards. Inland North Africa suit contains 6 (Column 2) country cards and 7 (Column 3) re(ion cards. Inland Southern Africa suit contains 9 (Column 2) country cards and 4 (Column 3) region cards.

A suit-by-suit review of the country cards and region cards comprising each suit of the African Landmass Area Deck, shows that the number of countries in each region varies. This variance results in the number of cards in each suit also varying. Adding place-filler cards as Region Cards smooths and evens out the number of suit cards. Region cards are, therefore, suit specific and may not be played outside their suit. Even though defined region cards only represent one particular place or one particular thing that is located within the region while undefined region cards represent the region overall, both defined and undefined region cards are played and valued exactly as other country cards. Region cards may not, however, represent an entire major political unit of the class being represented by the main informational cards of the deck. Region cards are played and valued exactly as other Country Cards. Table entries for the remaining five continental landmass area decks listed in Column 1, are interpreted essentially the same.

Continent Wild cards are an optional embellishment of suited country card decks that can enhance enjoyment during use and are included in the Suited Country Card Decks described herein. The number of Continent Wild Cards added herein equals the number of suits in the suited Country Card Deck. Column 5 shows the number of wild cards for each Country Card Deck and Column 6 shows the total number of cards in each deck.

Political Units and Region Cards of Suited Country Card Decks

Tables 2*a*–2*f* provides a suited-country-card-deck by suited-country-card-deck listing of the major political units or countries, or places, or things included in each of the 30 region suits. Each table gives the suits of the major landmass area deck and lists the names of the countries or major political units comprising the suit, as well as listing any regional cards used in the suit. The tables also illustrate how region cards are used to great advantage to provide the user with tiny chunks of additional, quite meaningful, information about the region and, thereby, increasing the locational aid value of the decks.

Region cards have increased locator suit configuration flexibility in a less obvious way as well. Use of region cards enabled utilization of type of landmass locator, coastline, as a point of reference for configuring African landmass area suits. Most of the countries of Africa have a coastline. Of the 57 countries, only 15 are completely landlocked. This fact allows for using having a coastline or not having a coastline as the basis for suiting. Appreciation of the utility of region cards in this regard is best grasped by seeing its application in locator suit configuration.

The Northern Africa Coastline stretches from the southern Mauritania border on the west coast to roughly the east-west center of Somalia on the east coast dividing Somalia into northern and southern regions. Therefore, the northern part of Somalia is represented by a country card in the Northern African Coastline suit. The southern part of Somalia is represented, however, on a region card in the Southeast African Coastline suit. This suit stretches from the hypothetical mid-point south alone the eastern coast and reaches out to embrace islands located east of the mainland before terminating roughly at the center of the South African coastline. The Southwest Africa Coastline suit then begins and embraces islands located in the southwestern waters and ends at the southwest border of Cameroon. The West Africa Coastline suit then begins at the northwest Cameroon Border and stretches along the West Africa coast before terminating at the northern Senegal border. The use of region cards has allowed the hypothetical split of Somalia into northern and southern parts to be taken into consideration without changing the number of country cards in a deck. This helps to maintain the integrity of the overall deck.

A somewhat different problem is solved through use of region cards in the case of the country of South Africa. South Africa has both eastern and western coastlines. Arbitrarily, the country is shown on a country card in the Southeast Africa Coastline suit. The western coastline is shown on a region card of the Southwest Africa Coastline suit. This display could have been reversed without substantive changer. Here, use of region cards allow for acknowledgement of the fact that within the suiting scheme employed, South Africa is represented in two different suits. If there had been a need for acknowledging South Africa's southern coast, a region card could have been similarly deployed to meet the need. Again, without jeopardizing the total number of country cards in the deck.

A third situation arises in using the coastline type of landmass locator in that a number of countries with coastlines also have considerable land inland. Use of region cards allow these major land areas to be considered in the two inland suits but on region cards. Again, the number of country cards in the deck is held steady to reflect the actual number of countries officially recognized by the International community while providing the user with important geographical information.

Canary Islands and St. Helena, are shown as part of the African Landmass Area, although they are (governed, administered, or actually belong to, politically; countries located outside of Africa. Region cards allow for acknowledgement of this without confusing card users. Ascension is a territory of St. Helena and thus is listed on a region card showing this relationship. Here, region TABLE 2a Regions/Suit
Names and Countries/Political Units for African Landmass Areas

| Northern African Coastline | Southeast African Coastline |
|---|---|
| 1. Algeria | 1. Comoros |
| 2. Cape Verde | 2. Kenya |
| 3. Djibouti | 3. Madagascar |
| 4. Egypt | 4. Mauritius |
| 5. Eritrea | 5. Mayotte |
| 6. Libya | 6. Mozambique |
| 7 Mauritania | 7. Reunion |
| 8. Morocco | 8. Seychelles |
| 9. Somalia-north | 9. South Africa |
| 10. Sudan | 10. Tanzania |

TABLE 2a-continued

| Regions/Suit Names and Countries/Political Units for African Landmass Areas | |
|---|---|
| 11. Tunisia | 11. Region Card: Somalia-south |
| 12. Western Saharas | 12. Region Card: |
| 13. Region Card: Canary Islands | 13. Region Card: |
| West Africa Coastline | Southwest African Coastline |
| 1. Benin | 1. Angola |
| 2. Cameroon | 2. Congo |
| 3. Cote d'Ivoire | 3. Equatorial Guinea |
| 4. Gambia, The | 4. Gabon |
| 5. Ghana | 5. Namibia |
| 6. Guinea | 6. Saint Helena |
| 7. Guinea-Bissau | 7. Sao Tome e' Principe |
| 8. Liberia | 8. Zaire |
| 9. Nigeria | 9. Region Card: Ascension Islands |
| 10. Senegal | 10. Region Card: South Africa |
| 11. Sierra Leone | 11. Region Card |
| 12. Togo | 12. Region Card: |
| 13. Region Card | 13. Region Card: |
| Inland Northern Africa | Inland Southern Africa |
| 1. Burkina Faso | 1. Botswana |
| 2. Central African Republic | 2. Burundi |

TABLE 2a-continued

| Regions/Suit Names and Countries/Political Units for African Landmass Areas | |
|---|---|
| 3. Chad | 3. Lesotho |
| 4. Ethiopia | 4. Malawi |
| 5. Mali | 5. Rwanda |
| 6. Niger | 6. Swaziland |
| 7. Region Card: Inland Algeria | 7. Uganda |
| 8. Region Card: Inland Egypt | 8. Zambia |
| 9. Region Card: Inland Libya | 9. Zimbabwe |
| 10. Region Card: Inland Mauritania | 10. Region Card: Inland South Africa |
| 11. Region Card: Inland Nigeria | 11. Region Card: Inland Zaire |
| 12. Region Card: Inland Sudan | 12. Region Card: |
| 13. Region Card: Lake Chad | 13. Region Card: |

TABLE 2b

| Regions/Suit Names and Countries for the Americas Landmass Area | |
|---|---|
| Northern Americas | Central Americas-west |
| 1. Bahamas, The | 1. Belize |
| 2. Bermuda | 2. Costa Rica |
| 3. Canada | 3. El Salvador |
| 4. Greenland | 4. Guatemala |
| 5. Mexico | 5. Honduras |
| 6. United States of America | 6. Nicaragua |
| 7. Region Card: Alaska State of the U.S.A. | 7. Panama |
| 8. Region Card: Aleutian Islands of Alaska | 8. Region Card: |
| 9. Region Card: Hawaii, State of the U.S.A. | 9. Region Card: |
| 10. Region Card: NW Territories of Canada | 10. Region Card |
| 11. Region Card: Queen Elizabeth Islands | 11. Region Card |
| 12. Region Card | 12. Region Card |
| 13. Region Card | 13. Region Card |
| Central Americas-central | Central Americas-east |
| 1. Aruba | 1. Antigua and Barbuda |
| 2. British Virgin Islands | 2. Barbados |
| 3. Cayman Islands | 3. Dominica |
| 4. Cuba | 4. Granada |
| 5. Dominican Republic | 5. Guadeloupe |
| 6. Haiti | 6. Martique |
| 7. Jamaica | 7. Montserrat |
| 8. Netherlands Antillies | 8. Saint Kits and Nevis |
| 9. Puerto Rico | 9. Saint Lucia |
| 10. Turks-Caicos | 10. Saint Vincent and the Grenadines |
| 11. Virgin Islands of the U.S.A. | 11. Trinidad and Tobago |
| 12. Region Card | 12. Region Card |
| 13. Region Card | 13. Region Card |
| Northern South Americas | Southern South Americas |
| 1. Columbia | 1. Argentina |
| 2. Ecuador | 2. Bolivia |
| 3. French Guiana | 3. Brazil |
| 4. Guyana | 4. Chile |
| 5. Suriname | 5. Falkland Islands of the United Kingdom |
| 6. Venezuela | 6. Paraguay |

TABLE 2b-continued

| Regions/Suit Names and Countries for the Americas Landmass Area | |
|---|---|
| 7. Region Card: Galapagos Islands of Ecuador | 7. Peru |
| 8. Region Card: | 8. Uruguay |
| 9. Region Card: | 9. Region Card: |
| 10. Region Card: | 10. Region Card: |
| 11. Region Card: | 11. Region Card: |
| 12. Region Card | 12. Region Card: |
| 13. Region Card: | 13. Region Card: |

TABLE 2c

Regions/Suit
Names and Countries/Political Units for Antarctica Landmass Areas

| Eastern Antarctica | Eastern Central-Antarctica |
|---|---|
| 1. Balleny Island | 1. American Highland |
| 2. Dibble Iceberg Tongue | 2. Amery Ice Shelf |
| 3. Mertz Glacier Tongue | 3. Belgica Mountains |
| 4. Mount Erebus | 4. Bouvet Island |
| 5. Mount Sabine | 5. Enderby Land |
| 6. Ross Ice Shelf | 6. Lambert Glacier |
| 7. Shackleton Ice Shelf | 7. Muhlighofmann Mountains |
| 8. South Magnetic Pole | 8. Napier Mountains |
| 9. Transantarctic Mountains | 9. Pensacola Mountains |
| 10. Victoria Land | 10. Pole of Inaccessibility |
| 11. Wilkes Lands | 11. Queen Fabiola Mountains |
| 12. Queen Maud Land | 12. Queen Maud Land |
| 13. Region Card | 13. West Ice Shelf |

TABLE 2c-continued

Regions/Suit
Names and Countries/Political Units for Antarctica Landmass Areas

| Western Antarctica | Western Central-Antarctica |
|---|---|
| 1. Byrd Land | 1. Adelaide Islands |
| 2. Executive Committee Range | 2. Alexander |
| 3. Getz Ice Shelf | 3. Antarctica Peninsula |
| 4. Hollick-Kenyon Plateau | 4. Berkner Island |
| 5. Mount Sidley | 5. Coats Land |
| 6. Rockefeller Plateau | 6. Filchner Ice Shelf |
| 7. Roosevelt Island | 7. Larsen Ice Shelf |
| 8. Thurston | 8. Mount Ulner |
| 9. Whitmore Mountains | 9. Ronne Ice Shelf |
| 10. Region Card | 10. South Orkney Islands |
| 11. Region Card | 11. South Shetland Islands |
| 12. Region Card | 12. Thiel Mountains |
| 13. Region Card | 13. Transantarctic Mountains |

TABLE 2d

Regions/Suit Names and Countries for the Asian Landmass Area

| Western Asia | Central Asia-West |
|---|---|
| 1. Bahrain | 1. Afghanistan |
| 2. Cyprus | 2. Iran |
| 3. Israel | 3. Iraq |
| 4. Jordan | 4. Kazakhstan |
| 5. Kuwait | 5. Kyrgyzstan |
| 6. Lebanon | 6. Pakistan |
| 7. Oman | 7. Tajikistan |
| 8. Quatar | 8. Turkmenistan |
| 9. Saudia Arabia | 9. Uzebkistan |
| 10. Syria | 10. Region Card: Russian Asian, NW |
| 11. Turkey | 11. Region Card |
| 12. United Arab Emirates | 12. Region Card |
| 13. Region Card | 13. Region Card |
| **Central Asia-east** | **Southeast Asia** |
| 1. Bangladesh | 1. Brunei |
| 2. Bhutan | 2. Cambodia |
| 3. China | 3. Hong Kong |
| 4. India | 4. Indonesia |
| 5. Maldives | 5. Laos |
| 6. Mongolia | 6. Macao |
| 7. Myanmar (Burma) | 7. Malaysia |
| 8. Nepal | 8. Phillippines |
| 9. Sri Lanka | 9. Singapore |
| 10. Region Card: Russian Asia North central | 10. Taiwan |
| 11. Region Card: | 11. Thailand |
| 12. Region Card: | 12. Vietnam |
| 13. Region Card: | 13. Region Card: Southeastern China |
| **Northeast Asia** | |
| 1. Japan | |
| 2. Korea, North | |
| 3. Korea, South | |
| 4. Region Card: Northeastern China | |

TABLE 2d-continued

| Regions/Suit Names and Countries for the Asian Landmass Area |
|---|
| 5. Region Card: Russian Asia, NE |
| 6. Region Card: Kuril Islands of Russia |
| 7. Region Card: Kamchatka Peninsula of Russia |
| 8. Region Card: Komandorsklye Islands of Russia |
| 9. Region Card: Sathalin Island of Russia |
| 10. Region Card: New Siberian Island |
| 11. Region Card: Severnaya Zemla |
| 12. Region Card: Attu Island of Alaska |
| 13. Region Card |

TABLE 2e

Regions/Suit Names for the European Landmass Area

| Eastern Europe | Central Europe-East | Central Europe-West |
|---|---|---|
| 1. Armenia | 1 Albania | 1. Austria |
| 2. Azerbaijan | 2. Estonia | 2. Bosnia and Hercegovina |
| 3. Belarus | 3. Greece | 3. Croatia |
| 4. Bulgaria | 4. Hungary | 4. Czech Republic |
| 5. Georgia | 5. Latviata | 5. Denmark |
| 6. Moldova | 6. Lithuania | 6. Germany |
| 7. Moldova | 7. Macedonia | 7. Italy |
| 8. Russian Europe | 8. Poland | 8. Lichenstein |
| 9. Ukraine | 9. Russia (Little) | 9. Malta |
| 10. Region Card | 10. Slovakia | 10. San Marino |
| 11. Region Card | 11. Yugoslavia | 11. Slovenia |
| 12. Region Card | 12. Region Card | 12. Switzerland |
| 13. Region Card | 13. Region Card | 13. Vatican City |
| **Western Europe** | **Northern Europe** | |
| 1. Andorra | 1. Iceland | |
| 2. Belgium | 2. Finland | |
| 3. France | 3. Norway | |
| 4. Gibraltar | 4. Sweden | |
| 5. Ireland | 5. Region Card: Nordic Russian Pembla | |
| 6. Luxembourg | 6. Region Card: Novaya Zemlya | |
| 7. Monaco | 7. Region Card: Franz Josef Land | |
| 8. Netherlands, The | 8. Region Card: Svalbard of Norway | |
| 9. Portugal | 9. Region Card | |
| 10. Spain | 10. Region Card | |
| 11. United Kingdom | 11. Region Card | |
| 12. Region Card | 12. Region Card | |
| 13. Region Card | 13. Region Card | |

TABLE 2f

Regions/Suit Names and Countries for the Oceanian Landmass Area

| Eastern Hemisphere Oceania-north | Western Hemisphere Oceanian |
|---|---|
| 1. Guam | 1. American Samoa |
| 2. Marshall Islands | 2. Cook Islands of New Zealand |
| 3. Micronesia, The Federated States of | 3. French Polynesia |
| 4. Northern Mariana Islands | 4. Hawaiian Islands of the USA |
| 5. Palau (Belau) | 5. Kiribati |
| 6. Region Card: East China Sea | 6. Pitcaim of U.K. |
| 7. Region Card: Japan | 7. Niue |
| 8. Region Card: Phillippine Islands | 8. Tokelau |
| 9. Region Card: South China Sea | 9. Tonga |
| 10. Region Card: Taiwan | 10. Wallis and Futuma Islands |
| 11. Region Card | 11. Western Samoa |
| 12. Region Card | 12. Region Card: Midway Islands |
| 13. Region Card | 13. Region Card: Line Islands Eastern |

TABLE 2f-continued

Regions/Suit Names and Countries for the Oceanian Landmass Area

| Eastern Hemisphere Oceania-central | Hemisphere Oceania-south |
|---|---|
| 1. Nauru | 1. Australia |
| 2. Papua New Guinea | 2. Christmas Islands |
| 3. Solomon Islands | 3. Cocos (Keeling) Islands |
| 4. Tuvalu | 4. Fiji |
| 5. Region Card: Banda Sea | 5. New Caledonia of France |
| 6. Region Card: Borneo | 6. New Zealand |
| 7. Region Card: Celebebes | 7. Norfolk Island of Australia |
| 8. Region Card: Greater Sundra Islands | 8. Tasmania of Australia |
| 9. Region Card: Indian Ocean | 9. Vanuatu |
| 10. Region Card: Indonesia | 10. Region Card: Auckland Islands |
| 11. Region Card: Irian Jaya Province of Indonesia | 11. Region Card: Coral Sea |
| 12. Region Card: Malaysia | 12. Region Card: Tasman Sea |
| 13. Region Card: New Guinea | 13. Region Card |

cards allow for an acceptable method for reflecting nuances of the political geography situation without distorting actual physical location.

These are just a few examples of the utility of place-filler cards in geography playing card decks. This one feature alone, significantly expands suiting configuration possibilities card play utility or the adaptability of the deck to the play of traditional card games, and convey additional units of relevant political geography facts, while simultaneously maintaining the overall integrity of the deck by allowing for the number of country cards to remain factually correct.

Attention is also called to the Northern Americas, Northeast Asia, North Europe, Eastern Hemisphere Oceania-north, and Eastern Hemisphere Oceania-central decks and suits. Each of these suits required a relatively large number of region cards in order to bring their total number of cards up to the number of cards in the suit with the highest number of country cards. Looking at the Northern Americas suit, it is evident that very important geographical information about the region has been conveyed through use of place-filler cards while maintaining the distinction between countries and places. Thus, the use of regional place-filler cards turns an otherwise insoluble difficulty into a real advantage. In sum, a place-filler card is a means for filling in what would otherwise be empty places, when in making a regional suited geography playing card deck, division of a geographical landmass area results in groups of cards having varying numbers.

The Unsuited Country Card Decks

The Unsuited Country Card Deck comprises a plurality of cards. Deck cards comprise country cards, country wild cards, and continent wild cards. These Decks are identical to corresponding suited country card decks with two major exceptions. First, no suit name appears on unsuited country cards. Second, Country Wild Cards arc used as place-filler cards in unsuited decks.

Unsuited Country Card Decks are utility decks. These decks allow users to test their knowledge of the location of major political units without benefit of the locator suit information that is provided on the cards of Suited Country Card Decks. Country Wild Cards may be viewed as representing a known or unknown ancient kingdom or community once located in the region to which a Country Wild Card is assigned. Country Wild Cards are thus merely place-filler cards like their regional counterparts but represent something different. Like their regional counterparts, Country Wild Cards are place-filler cards that are added to the various cards of a specific region until each region has the desired number of cards. The use of Country Wild Cards in this manner increases game play possibilities and maintains play continuity from the Suited Country Card Deck. Because they are only place-filler cards, it is strongly recommended that when used. Country Wild Cards should be played and valued exactly as other major political unit cards.

The Blotswanna Card Deck

The Blotswanna Card Deck contains a plurality of cards directing the compilation of a certain combination of cards from the World Regions or Country Card Decks for a particular hand of play. In addition to mandating the combination of cards needed for a particular hand of play, the Blotswanna Cards also assign a point value to the cards so compiled for the particular hand of play. Table 3. Blotswanna Cards for Africa, shows Blotswanna Card Deck structure, mandates, and points values for the African Landmass area.

Although, Country Card Decks can be used without the Blotswanna Card Deck, this element of the invention brings a new level of excitement to use of the cards. It also serves a number of other important purposes. The Blotswanna Card Deck overcomes the difficulties of assigning fixed point values to cards and hence is more equalitarian in its essential thrust. Blotswanna is a word coined for the deck to denote a beginning lot determined solely by chance. The lot, of course, is assignment to the player of a combination of cards to be compiled and assignment of a point value to the compiled cards for the particular hand of play only. Player card-combination assignments and point value of cards change from hand-to-hand of card play. Winning is a function of players' skill and luck. The use of Blotswanna Card Decks in this manner represents a major departure from traditional card value assignment methods of geography card decks. Further, other, more complex mandates can be constructed for Blotswanna Cards, as desired by the manufacturer.

Equally important, however, Blotswanna Cards structure player learning. They do this by directing player attention to geography and political geography facts. And, the directing of player attention is accomplished in a whimsical and nonauthoritative manner while being both whimsical and authoritative and educational as well.

TABLE 3

Blotswanna Cards for Africa

| Continent Region | Blotswanna Card Mandate Point Value | | | | |
|---|---|---|---|---|---|
| 1. Northern Africa Coast | 1 | 2 | 5 | 10 | 15 |
| 2. Southern Northwest Africa Coast | 1 | 2 | 5 | 10 | 15 |

TABLE 3-continued

Blotswanna Cards for Africa

| Continent Region | Blotswanna Card Mandate Point Value | | | | |
|---|---|---|---|---|---|
| 3. Central Africa-central | 1 | 2 | 5 | 10 | 15 |
| 4. East Africa Coast and Islands | 1 | 2 | 5 | 10 | 15 |
| 5. Southern Africa and Southwest Islands | 1 | 2 | 5 | 10 | 15 |
| 6. Northern Africa Coast and Southern Northwest Africa Coast | 1 | 2 | 5 | 10 | 15 |
| 7. Central Africa-central AND East Africa Coast and Islands | 1 | 2 | 5 | 10 | 15 |
| 8. Southern Africa and Southwest Islands AND Northern Africa Coast | 1 | 2 | 5 | 10 | 15 |
| 9. Southern Africa and Southwest Islands AND Central Africa-central | 1 | 2 | 5 | 10 | 15 |
| 10. One Card from four Regions AND two Cards from one Region | 1 | 2 | 5 | 10 | 15 |
| 11. Two countries from any three Regions | 1 | 2 | 5 | 10 | 15 |
| 12. Three countries from any two Regions | 1 | 2 | 5 | 10 | 15 |

Total African Blotswanna Cards = 60

Invention Methods

Having now provided a detailed description of the two main informational decks and a description of the two card play utility decks of the invention, attention now turns to the method used to produce the sets of decks. Making the basic locator suit improvements involves two-three main steps comprising:

1. Expanding the use of locators.
   a. Using directional locators including, more than just the cardinal points of the compass;
   b. Combining or Dividing positional locators as needed or desired. For example, the positional locator Central can be further divided into Central-north and Central-south; or Central-east and Central-west. It can also be combined into, for instance, Central-central as in Central Americas-central:
   c. Using type of landmass locators that include more than just type of landmass locator, "island." For example, Eastern Hemisphere Oceania, or, Northern Africa Coastline;
2. Instituting a naming convention for each of the smaller areas.
   a. Including the commonly accepted name of the major landmass area within which the smaller area is situated in the designated name for the smaller area. For example, North Europe.
   b. Including locator terms, in the name for one or more of the smaller areas, singly or in combination.
3. Adding place-filler cards to suits as desired.

These three small changes in method of locator suit development, as demonstrated in descriptions provided in earlier sections of this specification, generate somewhat astounding results. The Blotswanna Card Deck, however is a completely unique invention. Making the deck involves two major steps comprising:

1. Including the desired mandates on the cards
2. Assigning point values to the mandate of each card.

In sum, the structure of the invention comprises a set of four decks of cards for each of six continental areas. Each of the sets of decks are structured similarly. That is, each set comprises the same elements and is organized essentially the same. The sets of decks vary from each other only in the landmass area or groups of landmass areas being addressed, suit names, region card elements names of political units, the number of suits in a particular deck, and the names of any wild cards included in the Country Card Decks. Where maps are included on the cards, the maps will vary to appropriately reflect the landmass areas represented by a particular set of decks. The total number of cards in Country Card Decks may vary from landmass area to landmass area. The total number of cards in the Blotswanna Card Decks may also vary from landmass area to landmass area. The decks of the invention, as just described are aimed, primarily, for use by adolescents and adults and this concludes that description. Before turning attention to a description of the drawings, however, a brief description of a version of the invention designed for young children is now presented.

Young Child's Version of World Regions Deck

A simplified version of the World Regions Card Deck has been developed for use by young children. Table 4 displays the features of the deck. This deck provides a plurality of continental landmass area suits and a plurality of region cards. The major differences between this version and the version presented earlier lies in suit and region configurations, number of region cards, region card names, names and number of wild cards and structuring of suits so that each suit has an identical number of regions.

TABLE 4

Young Child's Version of the World Regions Card Deck

| African Landmass Area | 6 | Americas Landmass Area | 6 |
|---|---|---|---|
| North Africa | 1 | North America | 1 |
| East Africa | 1 | East Caribbean Islands of America | 1 |
| Southern Africa | 1 | South America | 1 |
| West Africa | 1 | West Caribbean Islands of America | 1 |
| Central Africa | 1 | Central America | 1 |
| Islands of Africa | 1 | Western Islands of America | 1 |
| **Asian Landmass Area** | **6** | **European Landmass Area** | **6** |
| North Asia | 1 | North Europe | 1 |
| East Asia | 1 | East Europe | 1 |
| South Asia | 1 | South Europe | 1 |
| West Asia | 1 | West Europe | 1 |
| Central Asia | 1 | Central Europe | 1 |
| Islands of Southern Asia | 1 | Islands of Europe | 1 |
| **Oceanian Landmass Area** | **6** | **Antarctica Landmass Area** | **6** |
| North Oceania | 1 | Executive Committee Range of Antarctica | 1 |
| East Oceania | 1 | East Antarctica Central Antarctica | 1 |
| South Oceania | 1 | Soutb PoIe at Antarctica | 1 |
| West Oceania | 1 | West Antarctica | 1 |
| Central Oceania | 1 | Central Antarctica | 1 |
| Southern Islands of Oceania | 1 | South Magnetic Pole at Antarctica | 1 |
| World Wide Wild Cards | 3 | | |
| Total Number of Cards | 39 | | |

This simplified version is constructed with an understanding that, in general, the level of cognitive development of most young children make it difficult for them to comprehend intercardinial and intermediary points of directions and more complicated combinations of locators. Thus as Table 4 shows region names are generally limited to either a cardinal point directional locator and the name of the continental landmass area, or a positional locator and the name of the continental landmass area or type landmass locator and the name of the continental landmass area.

Another consideration relates to the number of cards that a young child can comfortably manipulate. This consideration dovetails the high priority value of providing complete coverage of world regions. This consideration resulted in limiting the number of region cards, in the basic decks to one card to each region even so, the child can play a number of matching games with this small number of cards. For ample compiling card combinations consisting of all "north" region cards or all "South" region cards, or all of the cards for one continental landmass area suit will intrigue children for hours at a time. The Antarctica suit can also be used in compiling combinations of all "north " or all "south" etc. card combinations, with a little imagination, as follows. The Executive Committee Range region card is played as a north card because the Committee represents nations from around the world and these nations are all located, of course, north of Antarctica. The South Pole region card is, of course, the purest "south" or, the southernmost point on earth's surface. The South Magnetic Pole is a field of force that is made up of many smaller fields of force. Islands are small land areas completely surrounded by water. Just as there are many smaller force fields, there are also many islands on earth's surface. And, so the South Magnetic Pole region card is played as a substitute for the island card. Other explanations can also be devised, as desired.

The size of the deck can readily be adjusted, however, to fit varying levels of maturation, by removing suits or specific region cards as desired. Thus, those uncomfortable with providing explanations about the Antarctica suit could remove it, or simply remove the South Magnetic Pole and the Islands region cards from other suits, as well. Conversely, as the child matures, the addition of another deck to the basic deck allows for play of, relatively, more complicated card matching games. As the child matures, parents may then wish to further increase the number of matches the child needs to make by combining three or more of the basic decks. These combined decks could also be configured as desired Young Child's Version of Country Card Decks Moreover, gradual introduction and regular use of country card decks suited to conform with the simplified suits of this basic deck will also provide the child with regular exposure to a variety of the languages of the world via the names of political units. Table 4*a* shows elements and structure of such a suited country card deck for the African continental landmass area.

Table 4*a* shows that undefined region wild cards are used in these decks. Like their counterpart undefined region cards, undefined region wild cards do not provide the name of a place or thing located in the region being represented by the suit. Designating the cards as "wild" in this instance merely adds to amusement from deck use. The cards are played and valued exactly as their counterpart undefined region cards. Using only undefined cards limits the amount of information the younger child must concentrate on while use of undefined region cards places all of the emphasize on the names of countries. Even more sophisticated play of card-combination games can be achieved when the basic deck is used with its companion Blotswanna Card Deck. Companion Blotswanna Card Decks are similarly simplified. Table 4*b* displays Blotswanna Card mandates for this simplified version of the invention.

TABLE 4a

Regions and Countries for African BOP

| North Africa | East Africa | South Africa |
|---|---|---|
| 1. Algeria | 1. Djibouti | 1. Angola |
| 2. Egypt | 2. Eritrea | 2. Botswana |
| 3. Libya | 3. Ethiopia | 3. Lesotho |

TABLE 4a-continued

Regions and Countries for African BOP

| | | | | | |
|---|---|---|---|---|---|
| 4. | Mauritania | 4. | Kenya | 4. | Malawi |
| 5. | Morocco | 5. | Somolia | 5. | Mozambique |
| 6. | Tunisia | 6. | Tanzania | 6. | Namibia |
| 7. | Western Sahara | 7. | Region Wild Card | 7. | South Africa |
| 8. | Region Wild Card | 8. | Region Wild Card | 8. | Swaziland |
| 9. | Region Wild Card | 9. | Region Wild Card | 9. | Zambia |
| 10. | Region Wild Card | 10. | Region Wild Card | 10. | Zimbabwe |
| 11. | Region Wild Card | 11. | Region Wild Card | 11. | Region Wild Card |
| 12. | Region Wild Card | 12. | Region Wild Card | 12. | Region Wild Card |
| 13. | Region Wild Card | 13. | Region Wild Card | 13. | Region Wild Card |
| West Africa | | Central African | | African Islands | |
| 1. | Benin | 1. | Burundi | 1. | Comoros |
| 2. | Burkina Faso | 2. | Cameroon | 2. | Madagascar |
| 3. | Cape Verde | 3. | Central African Republic | 3. | Mayotte |
| 4. | Cote d'Ivoire | 4. | Chad | 4. | Mauritius |
| 5. | Gambia, The | 5. | Congo | 5. | Re'union |
| 6. | Ghana | 6. | Equatorial Guinea | 6. | St. Helena |
| 7. | Guinea | 7. | Gabon | 7. | Seychelles |
| 8. | Guinea Bissau | 8. | Niger | 8. | Sao Tome'e principe |
| 9. | Liberia | 9. | Nigeria | 9. | Region Wild Card |
| 10. | Mali | 10. | Rwanda | 10. | Region Wild Card |
| 11. | Senegal | 11. | Sudan | 11. | Region Wild Card |
| 12. | Sierra Leone | 12. | Uganda | 12. | Region Wild Card |
| 13. | Togo | 13. | Zaire | 13. | Region Wild Card |

TABLE 4b

BLOTSWANNA CARD MANDATES FOR AFRICA

| CONTINENT REGION | POINT VALUE OF BLOTSWANNA CARD | | | | |
|---|---|---|---|---|---|
| 1. North Africa | 1 | 2 | 5 | 10 | 15 |
| 2. East Africa | 1 | 2 | 5 | 10 | 15 |
| 3. South Africa | 1 | 2 | 5 | 10 | 15 |
| 4. West Africa | 1 | 2 | 5 | 10 | 15 |
| 5. Central Africa | 1 | 2 | 5 | 10 | 15 |
| 6. African Islands | 1 | 2 | 5 | 10 | 15 |
| 7. Northand East Africa | 1 | 2 | 5 | 10 | 15 |
| 8. East and South Africa | 1 | 2 | 5 | 10 | 15 |
| 9. South and West Africa | 1 | 2 | 5 | 10 | 15 |
| 10. Central and African Islands | 1 | 2 | 5 | 10 | 15 |
| 11. One Country from each African Region | 1 | 2 | 5 | 10 | 15 |
| 12. Two countries from any three Regions | 1 | 2 | 5 | 10 | 15 |
| 13. Three countries from any two Regions | 1 | 2 | 5 | 10 | 15 |
| 14. Three countries from North and Three from East | 1 | 3 | 5 | | |
| 15. Three countries from East and Three from South | 1 | 3 | 5 | | |
| 16. Three from South and Three from West | 1 | 3 | 5 | | |
| 17. Three from West and Three from Central | 1 | 3 | 5 | | |
| 18. Three from Central and Three African Islands | 1 | 3 | 5 | | |
| 19. Three African Islands and Three from North | 1 | 3 | 5 | | |

The size of the Blotswanna Card Deck may also be adjusted to fit the child's own comfort level.

In sum, learning to enjoy geography at an early age via these simple games will have a positive impact on the child's view of the world, sense of mastery, and future educational achievement as well. By 5th or 6th grade, the child who has played with these cards regularly will have a much limber Orotund in political geography facts than the child who has not. Thus. The young child's version of the invention places a simple but powerful, flexible, safe, and enjoyable, social and educational tool into the hands of parents. Now for a description of the drawings.

DESCRIPTION OF THE DRAWINGS

Because the sets of decks are (generated from the same method, they are structured similarly and given the prior discussion of elements and overall structure of the decks, the reader will garner a good understanding of the operation of all sets of decks from the drawings illustrating typical cards of one set of decks. For purposes of continuity of discussion, a deck by deck illustration of typical cards is presented. It is felt that the close similarity between adult and young child versions of the card decks makes it redundant to include drawings for the cards of the young child's versions of the decks. Thus drawings for young child's versions are not included. The cards being shown are from the adult version of the set of decks representing the landmass area of Africa.

Reference Numerals In Drawings

| | | | |
|---|---|---|---|
| 10 | a typical card | 24 | regional card designation |
| 12 | front side of card | 26 | country card designation |
| 14 | back side of card | 28 | name of place or thing located in region |
| 16 | name of landmass area covered by deck | 30 | wild card designation |
| 18 | suit name | 32 | Blotswanna card mandate |
| 20 | region name | 34 | point value for Blotswanna card mandate |
| 22 | name of country or major political unit | 36 | Blotswanna card designation |

The World Regions Card Deck

Figure 1A:
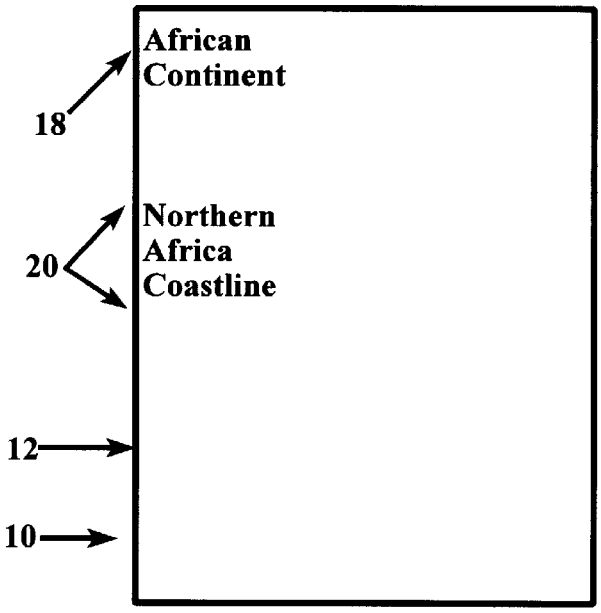
FIG. 1*a* shows the front side of a Region Card of the Region Card Deck

FIG. 1 shows the common backside 14 of a typical card 10 of the World Regions Card Deck. The backsides 14 of all the cards of the World Regions Card Deck are visually-similar. The landmass area covered by the deck 16 is also given. FIG. 1*a* shows the front side 12 of a typical card 10 of World Regions Deck. The suit name 18 is shown in the upper left corner. The region card name 20 is given below the suit name 18.

The Blotswanna Card Deck

Figure 2:
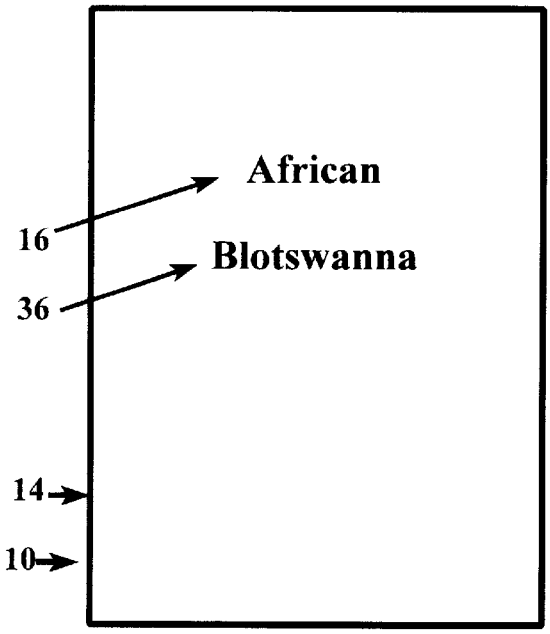
FIG. 2 shows the common back side of all cards in the Blotswanna Card Deck
Figure 2A:
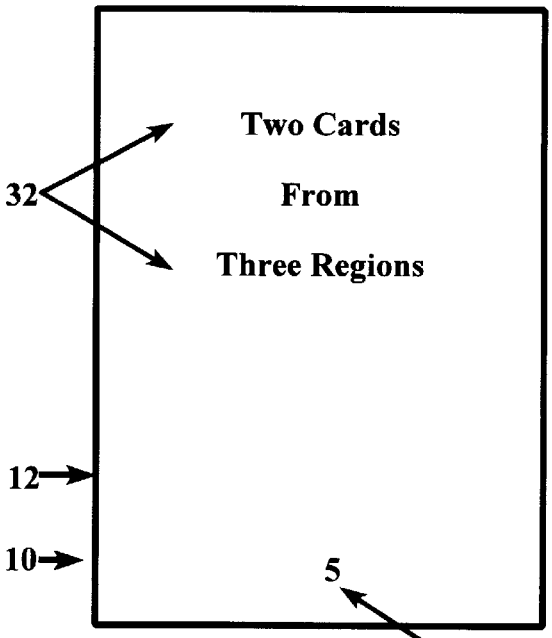
FIG. 2*a* shows the front side of a typical card from the Blotswanna Card

FIG. 2 shows the common backside 14 of a typical card 10 of the Blotswanna Card Deck. The backsides 14 of all the cards of the Blotswanna Card Deck are visually-similar. The landmass area covered by the deck 16 is prominently displayed as is the Blotswanna Card Deck 36 designation. FIG. 2*a* shows the front side 12 of a typical card 10 of the Blotswanna card Deck. The Blotswanna Card Mandate 32 indicating the required combination of cards that must be compiled for the hand is prominently displayed. The point value 34 for each of the cards compiled into the required combination, or laid in a spread, during the hand of play is also prominently displayed at the bottom center of-the card.

The Suited Country Card Deck

Figure 3:
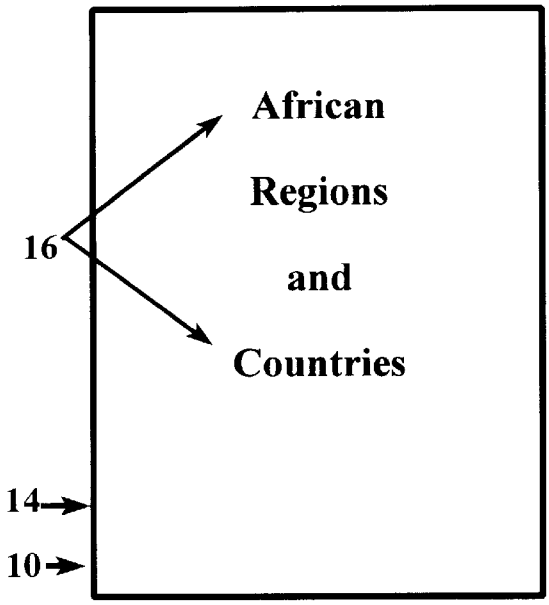
FIG. 3 shows the common back side of all cards of the suited Country Card Deck
Figure 3A:
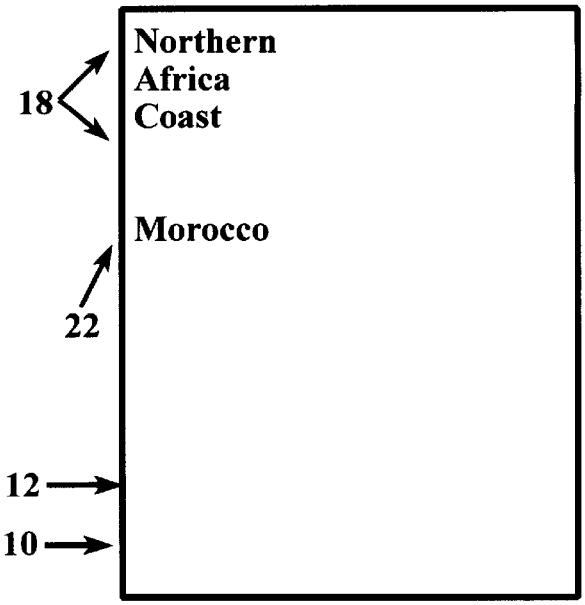
FIG. 3*a* shows the front side of a country card of the suited Country Card Deck

FIG. 3 shows the common backside 14 of a typical card 10 of the Suited Country Card Deck. The backsides 14 of all the cards olthe Suited Country Card Deck are visually-similar. The landmass area covered by the deck 16 is also given. FIG. 3*a* shows the front side 12 of a typical card 10 of the Stilted Country Card Deck. The appropriate suit name 18 is shown in the upper left corner. The name of the major political unit 22 is given below the suit name 18.

Figure 3B:
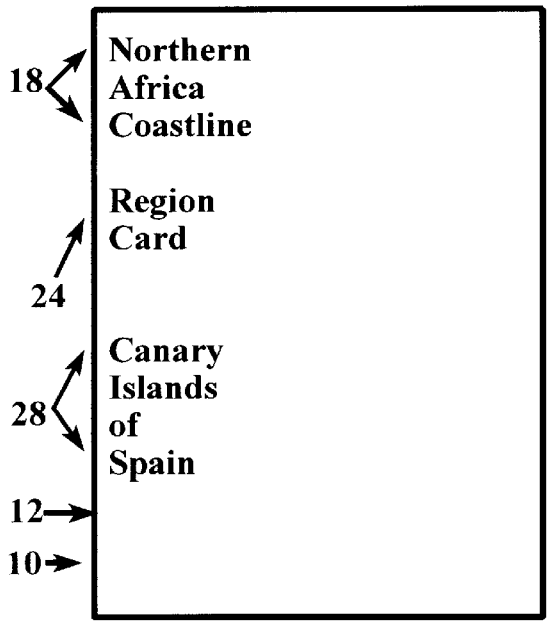
FIG. 3*b* shows the front side of a Regional Card of the suited Country Card Deck

FIG. 3*b* shows the front side 12 of a typical card 10 designated as a Defined Region Card. The appropriate suit name 18 is shown in the upper left corner. The regional card designation 24 is (given below the suit name 18. The name of a place or thing located in the region 28 is given below the region card designation 24. As described earlier in this specification, the use of regional cards was devised to overcome the problem of having suits of unequal numbers. The regional cards fill in for a true major political unit.

Figure 3C:
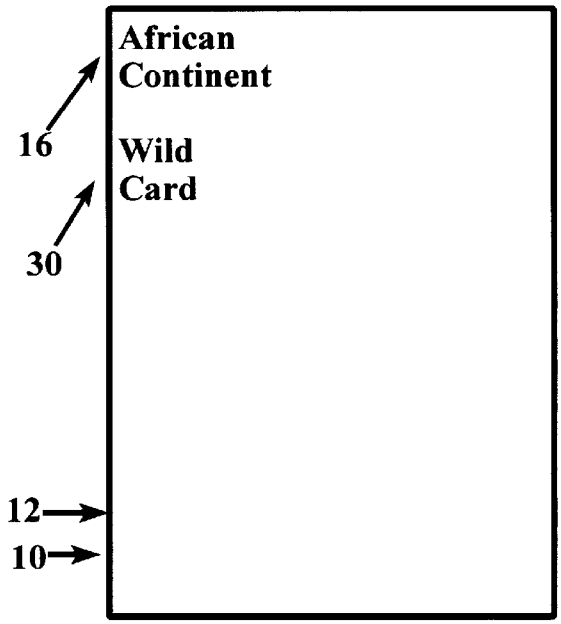
FIG. 3*c* shows the front side of a Continent Wild Card of the suited Country Card Deck

Therefore, regional cards of the country card deck are place-filler cards that are added to the various suits of a deck until each of said suits has a number of cards that is equal to the number of cards in the suit having the largest number of cards representing political units. Place-filler cards can also be used to simply increase the overall number of cards in all suits, if such an effect is desired. Because they are only place-filler cards, it is strongly recommended that region cards be played and valued exactly as the country cards of a suit. FIG. 3*c* shows the front side 12 of a typical card 10 designated as a Continent Wild Card. Continent Wild Cards may also be included in the Country Card Decks to add an added edge of excitement. The name of the major landmass 16 represented by the deck is given in the upper left corner of the card. The card is identified as a wild card 30 immediately below the name of the major landmass name 16 represented by the deck.

The Unsuited Country Card Deck

Figure 4:
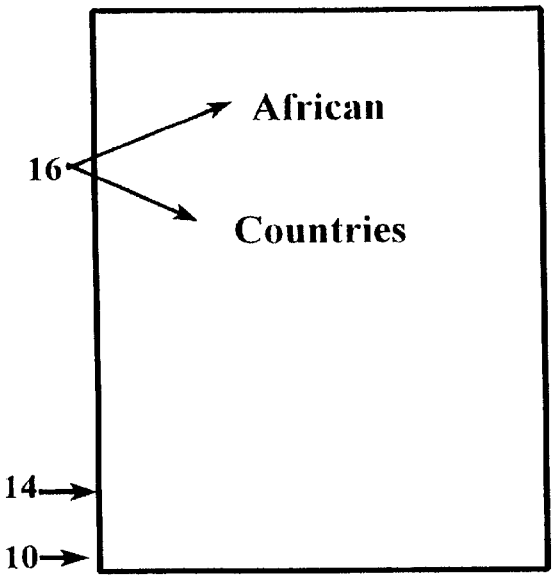
FIG. 4 shows the common back side of all cards of the unsuited Country Card Deck
Figure 4A:
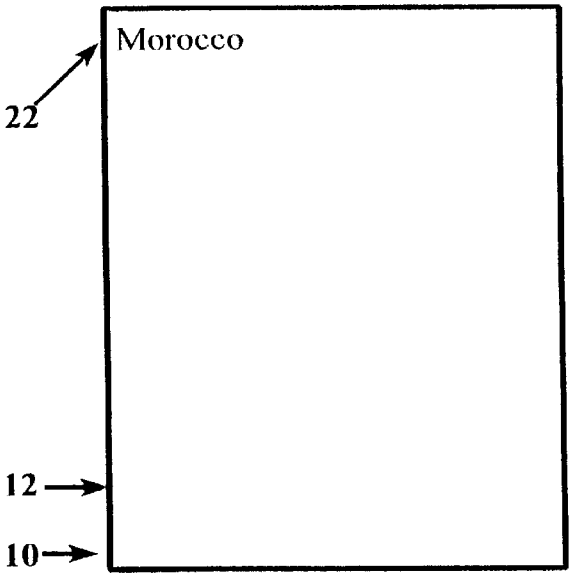
FIG. 4*a* shows the front side of a country card of the unsuited Country Card Deck
Figure 4B:
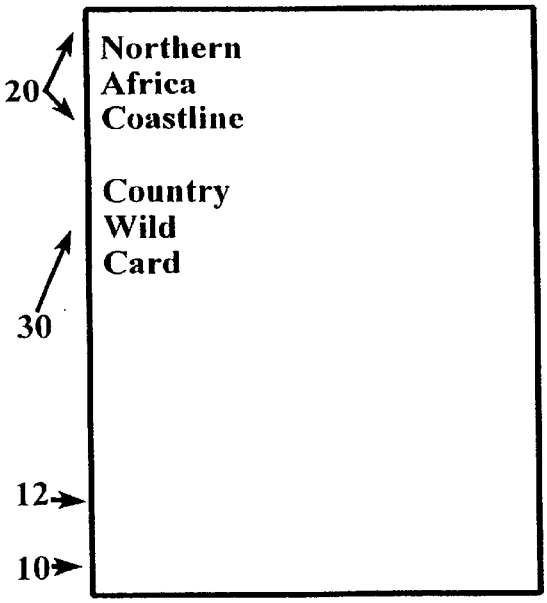
FIG. 4*b* shows the front side of a Country Wild Card of the unsuited Country Card Deck

FIG. 4 shows the common backside 14 of a typical card 10 of the Unsuited Country Card Deck. The backsides 14 of all the cards of the Unsuited Country Card Deck are visually-similar. The landmass area covered by the deck 16 is also given. FIG. 4*a* shows the front side 12 of a typical card 10 of the Unsuited Country Card Deck. The name of the major political unit 22 is (liven in the upper left corner. FIG. 4*b* shows the front side 12 of a typical card 10 designated as a Country Wild Card. Country Wild Cards are like their regional counterparts, region specific. The appropriate region name 20 is shown in the upper left corner. The Country Card designation 26 is also given below the region name 20. The Wild Card designation 30 is given below the country card designation 26.

As described earlier in this specification, the use of country wild cards is employed to maintain continuity of play from the Suited Country Card Deck to the Unsuited Country Card Deck, with only a minor adjustment for players relative to the type of wild card designation and the absence of suit names. The major purpose of the deck, however, is to provide players with a more challenging deck and one that can be used to allow for player self-assessment of the learning process.

Figure 4C:
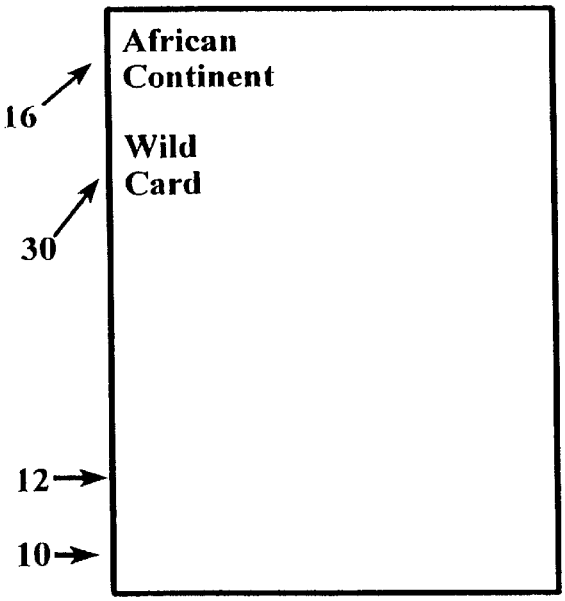
FIG. 4*c* shows the front side of a Continent Wild Card of the unsuited Country Card Deck

Continent Wild Cards can be added to the Unsuited Country Card Deck where a premium value card and/or a flexible play card is desired. FIG. 4*c* shows the front side 12 of a typical card 10 designated as a Continent Wild Card. The name of the major landmass 16 represented by the deck is given in the upper left corner of the card. The card is identified as a wild card 30 immediately below the name of the major landmass name 16 represented by the deck.

The overall structure of the invention having thus been described, elemental units explicated in detail, method of making locator suits explained, and illustrative card drawings displayed and described, attention now turns to a detailed description of a basic game developed for play with the decks. The game can be played with Country Card or World Regions Card Decks but description of play herein is limited to the Subtitled Country Card and Blotswanna Card Decks. Adaptation for use with the World Regions Card and Blotswanna Card Deck versions of game play will then be summarized. Thus, unless otherwise stated, the term "Country Card Deck," in the game description which follows, refers to the Suited Country Card Deck.

An Adaptation of Rummy: A Game called BOP

The game is called BOP About the World or "BOP," for short. The name of the major landmass area or grouping of landnmass areas represented by a pair of decks may be added to the short title such that there is African BOP, American BOP, Asian BOP, European BOP and Oceania BOP. The full title is then reserved to indicate game play with the World Regions Card Deck. BOP also illustrates how readily the play of popular card games can be adapted for play with the various sets of decks. Another way of thinking about BOP is as a game of GeoRummy.

Game Objective

The object of the games is to score more points than other players by laying a six-card spread that fulfills the conditions mandated by the player's Blotswanna Card, for the hand of play. Fulfilling the conditions of the blotswanna, for the hand of play, is called BOPPING.

Dealing the Cards

1. The Dealer shuffles the Blotswanna Deck.
2. Another player cuts the Blotswanna Deck.
3. The Dealer deals each player one Blotswanna card facedown. Players may look at their card but should not allow other players to see it.
4. After each player has received a Blotswanna Card, the dealer sets the remaining cards aside.
5. The dealer then shuffles the Country Card Deck thoroughly.
6. Another player cuts the Country Card Deck.
7. The Dealer then deals each player six cards from the Country Card, facedown, using the standard deal (one card at a time to each player, clockwise, six times).
8. After completing the deal, the Country Card Deck is placed facedown in the middle of the table.

Understanding the Game

1. Once game play has started each player must take his turn at play and keep six Country Card Deck cards in his hand at all times.
2. Turns at play pass clockwise, around the table from player to player.
3. Except for the player who starts play, turns at play present the player with two major choices:
   the choice to pull a card from the country card deck, OR
   the choice to use the card discarded by the player before him.
4. If a player decides to pull from the Country Card Deck rather than use a discarded card:
   He may discard the pulled card and play then proceeds to the next player, OR
   He may decide to add the card to his hand. If he adds the card to his hand, however, he must then discard another card from his hand. Play then proceeds to the next player.
5. A players turn at play has not ended until he has discarded a card. Therefore, other players may not pull from the Country Card Deck until after the current player has discarded a card.
6. Only the player next in line for a turn at play may use a discarded card. If that player decides to pull from the Country Card Deck rather than use the discarded card, the discarded card is now dead for the purposes of play. No other player may use it.
7. Cards are placed onto the discard pile faceup and in the order of their deposit. The last discarded card is always faceup on the top of the discard pile.

Playing the Game

The elements described above are the basic rules for playing the game. The following brief scenarios combines these elements by describing the first few cycles of play.

1. The first player to the left of the dealer (Player #1) starts play by pulling a card from the Country Card Deck and examining it.
   If Player #1 decides that the card will not help him to fulfill his Blotswanna mandate, he will want to discard it,front side up, and start the discard pile.

Player #1 decides, however, that the pulled card will help him to fulfill his Blotswanna for the hand, he will want to keep the card in his hand but must then discard another card from his hand,front side up, onto the top of the discard pile.

2. The next player (Player #2) will want to examine the card discarded by Player #1 before deciding whether or not to pull from the Country Card Deck.

Player #2 decides that the card discarded by Player #1 will not help him to fulfill his Blotswanna. Thus, he opts to pull from the Country Card Deck. The card discarded by Player #1 is now dead to further play.

If Player #2 decides that the pulled card will help him fulfill his Blotswanna for the hand, he will want to add the card in his hand but must then discard another card from his hand, front side up, onto the top of the discard pile started by Player #1. Play then passes to the next player.

If Player #2 had decided, however, that the pulled card would not help him to fulfill his Blotswanna, he would discard it onto the top of the discard pile. Play would then pass on to the next player.

If Player #2 had decided, however, that the card discarded by Player #1 would help him to fulfill the conditions of his Blotswanna; instead of pulling a card from the Country Card Deck, Player #2 would have picked up the card discarded by Player #1 and added it to his own hand.

After adding the card to his hand, however, Player #2 would then be obliged to discard another card from his own hand. Play would then pass to the next player.

3. Player #3 begins his turn by examining the card discarded by Player #2 and the cycle of play described in (2.), above, begins again.
4. The cycle of play continues in this manner, one player at a time, until a player fulfills the mandate of his Blotswanna and calls BOP.

Bopping

1. Immediately upon fulfilling the conditions of the player's Blotswanna, for the hand of play; and before discarding, the player must call "BOP."
2. After calling "BOP," the player must discard his seventh card and then lay out, faceup, his Blotswanna card alongside his six card spread and all play ends.
3. Announcing "BOP" prior to the discarding seventh card signals to other players not to continue play by pulling a card from the Country Card Deck.
4. If a player fails to call "BOP" prior to discarding a card, play continues and other players may "BOP."
5. Players will want to examine the Bopping player's spread to be sure it does fulfill the conditions of the Bopping player's Blotswanna for the current hand of play.
6. If the spread does not meet the conditions of the Bopping player's Blotswanna, play moves on to the next player. Therefore, when a player calls "BOP," other players will want to fold their hands, front side down, until they have checked the Bopping player's spread with his Blotswanna card.

Scoring

Continent Wild Cards: Play and Point Value

Continent Wild Cards are not subject to the Blotswanna and may be used in a spread for any region of a continent. Continent Wild Cards also have premium point value in a Bopping Blotswanna spread of 20 points per Continent Wild Card included in the Bopping spread. Although Continent Wild Cards are not subject to the Blotswanna, they have no point value unless they are part of a Bopping Spread.

Country Cards: Values and Scoring

1. Only the Bopping player accumulates points for the hand of play. Points are earned for each Country Card in the six-card spread, in accordance with the point value assigned for country cards.
2. Country Card point values are located on the bottom center of the player's Blotswanna card.
3. Blotswanna cards set Country Card point values from 1–15 points.
4. Region Cards take on the Blotswanna assigned country card point value.

Scoring Examples

Suppose a player's Blotswanna Card assigns a point value of 1 for Country Cards. And suppose the player Bops. laying a spread containing 1 Continent Wild Card, 1 Region Card and four other country cards that fulfill his Blotswanna for the hand of play. The player's score for the hand would be 20+5=25 points.

Suppose a player's Blotswanna Card assigns a point value of 15 for Country Cards. And suppose the player Bops. laying a spread containing 1 Continent Wild Card, 1 Region Card and four other country cards that fulfill his Blotswanna for the hand of play. The player's score for the hand would be 20+(5×15)=95 points.

Suppose a player's Blotswanna Card assigns a point value of 5 for Country Cards. And suppose the player Bops, laying a spread containing 2 Region Cards and four other country cards that fulfill his Botswana for the hand of play. The player's score for the hand would be 5×6=30 points.

Resuming Play after a Player Bops

1. After a player Bops, all Blotswanna cards are returned to the Blotswanna Deck and all Country Cards are returned to the Country Card Deck.
2. The Deal moves on to the next player on the left.
3. Both decks should be thoroughly reshuffled by the dealer.
4. Hand 2 of play begins by dealing the cards as described earlier.
5. Play then continues as described earlier until at least 3 hands have been played.

Winning and Hands of Play

1. The player with the highest score at the end of three hands of play wins one game.
2. In the rare event of a tie, after three hands of play, additional hands are played, one hand at a time, until one player has earned a higher number of points than any other player.

Game Length

A short game consists of three hands of play. As more proficiency in play is obtained, game length may be varied to five, seven, or nine hands of play.

Bop About the World Using the World Regions Card Deck Only

To play the game with the World Regions Card Deck without the Blotswanna card deck, as a straight forward, card pair matching game requiring little explanation. Game objective is to make the most matching, pairs of region cards. The deal proceeds as described earlier except that no Blotswanna card is dealt and each player is dealt a predetermined odd number of cards from the World Regions Card Deck. Players may decide to play to exhaust the deck or they may choose to play a limited number of hands. For instance, five cards could be dealt to each player and the player Bops when he has five matched pairs compiled through the pull and play method described earlier. Each matched pair could be worth ten points. Thus the difference in play relates to the absence of a Blotswanna Card Mandate. An interesting variation, however, would include the North and South Pole Wild Cards. Another interesting, two player, variation would establish a game objective as compiling matched pairs for regions completely above the equator for one player and completely below the equator to the other player. Possibilities for interesting game play are practically infinite.

Invention Modifications

The locator Suit configurations shown, in Tables 1 through 2, are just a few of numerous locator suit configurations, now possible, using the basic method for making locator suits, described earlier in this specification. The method can also be applied to other media as well. A number of modifications can be made to the invention without substantially affecting the basic method of the invention.

Conclusion

The basic invention, instant apparatus, and games having thus been shown and described, in detail, it can be seen that the invention provides a useful and versatile method for teaching/learning political geography facts.

What is claimed as new and desired to secure by Letters Patents is:

1. A main informational deck of geography playing cards comprising:

a. a main informational deck of cards having a plurality of cards divided into a plurality of regional suits, each of said regional suits having the same number of cards; said main informational deck representing a landmass area, said landmass area being divided into smaller areas or regions and one or more of said regions having a plurality of major political units being located therein; the cards of said deck having a first indicia, said first indicia including said landmass area;

b. each of said regional suits representing one of said smaller areas or regions and each card of said regional suits having a second indicia, said second indicia indicating one of said regions wherein each region is represented by a different regional suit;

c. The cards of the deck having a plurality of main informational cards and one or more place-filler cards, each main informational card in each regional suit having a third indicia indicating a major political unit located within the region represented by said main informational card;

wherein at least one regional suit having a different number of main informational cards than at least one so the other of said regional suits, wherein said place-filler cards in said at least one regional suit providing additional cards in said at least one regional suit so that said at least one regional suit having the same number of cards as the other of said regional suits, said place-filler cards also being called region cards.

2. The main informational deck of claim 1 wherein said place-filler cards having a fourth indicia designating each of said place-filler cards as being a region card, said place-filler cards including undefined place-filler cards, said undefined place-filler card rescilting all of the places and all of the things being located within said region such that said region being represented as a whole and each of said undefined place-filler cards including said first, second, and fourth indicia and having no third indicia.

3. The main informational deck of claim 2 wherein one or more of said place-filler cards including defined place-filler cards, said defined place-filler cards representing a specific place or thing being located within said region, each of said defined pace-filler card including a first, second, fourth and a fifth indicia, said fifth indicia indicating the specific place or thing being represented by said defined place-filler card.

4. The main informational deck of claim 3 wherein said second indicia including:

(1) a commonly accepted name for the landmass area being represented by said deck and (2) one or more tens taken from the group consisting of directional locators, positional locators, and type of landnmass locators.

5. The main informational deck of claim 4 wherein said deck representing a continental landmass area and a. each of said main informational cards representing one country, said country being located within one of said regions being represented by one of said regional suits and said main informational cards also being called country cards;

b. said place-filler cards being place-filter cards selected from the group consisting of defined place-filler cards and undefined place-filler cards, said place-filler cards being selected from the group consisting of defined place-filler cards and undefined place-filler cards also being called region cards.

6. The main informational deck of claim 5 wherein each of said country cards and each of said region cards having a front side and a back side;

a. the back side of said country cards and the back side of said region cards being visually similar, said backsides having said first indicia thereon, said first indicia indicating the continental landmass area being represented by said deck and further indicating the name of the main informational deck to which said country cards and said region cards belonging;

b. the front side of each of said country cards being distinctive having said second indicia and said third indicia thereon, said second indicia indicating the regional suit to which said country card belonging and said third indicia indicating the name of the country being represented by said country card;

c. the front side of said region cards being distinctive having said second indicia and said fourth indicia thereon, said second indicia indicating the regional suit to which said region card belonging, said fourth, indicia further designating said card as being a region card, and where said region card being a defined region card, said defined region card having said fifth indicia, said fifth indica further indicating a specific place or thing being located within said region, said specific place or thing also being represented by said defined region cards.

7. The main informational deck of claim 6 further including one or more wild cards wherein a. said wild cards being called Continent Wild Cards;

b. each of said Continent Wild Cards representing the continental landmass area being represented by said deck;

c. each of said Continent Wild Cards having a front side and a back side (1) the front side of each of said wild cards being visually similar having a sixth indicia thereon designating said card as being a wild card and said front side also having said first indicia thereon, said first indicia designating the continental landmass area being represented by said wild card;

(2) the back side of each of said wild cards being visually-similar to the bask sides of the Suit cards of said deck, said backsides having said first indicia thereon, said first indicia indicating the continental landmass area being represented by said deck and further including the name of the main informational deck to which said wild card belonging.

8. The main informational deck of claim 7 further having a companion deck of playing cards, said companion deck of playing cards having a plurality of cards and a plurality of sets of cards:

a. each card of said companion deck having a numerical value imprinted thereon, said numerical value assigning a point value to certain cards of said main informational deck from hand-to-hand or round-to-round of card play, each card of said companion deck further having a phrase imprinted thereon, said phrase referencing one or more regional suits of said trait informational deck of cards, said phrase being called a rnandate, said phrase also being called a card mandate;

b. Each set of cards iii said companion having a predetermined number of cards, the cards of a particular set of companion deck cards each having the same mandate, said mandate referencing one or more of the regional suits of said main informational deck of cards and the mandate of any particular set of cards being different from the mandates of other sets of cards in said companion card deck, each of said mandates identifying a particular combination of cards needing compilation for a particular hand or round (of card play;

c. each card of a particular set of companion deck cards having a numerical value different from the numerical values imprinted on other of the cards of said particular set of cards;

d. each card of said companion deck having a front side and a back side;

(1) (he front side of said companion deck cards being distinctive, each of said front sides having specific in formation thereon, said specific information including a mandate describing a particular combination of cards needing compilation form the cards of said main informational deck, said specific information including a numerical value thereon, said number assigning a point value to each of the cards of said particular combination of cards being described on said companion deck card;

(2) the back side of each of said cards being visually-similar; said back sides having said first indicia thereon, said first indicia indicating a continental landmass area being represented by said main informational deck and further distinguishing the cards of said companion deck from the cards of said main informational deck.

9. The main informational deck of claim 1 having one or more wild cards, said wild cards representing the land mass area being represented by said main informational deck, each of said wild cards having a first side and a back side;

a. The front sides of each o)f said wild cards being visually-similar having said sixth indicia thereon, said sixth indicia being distinctive to designate said card as being a wild card and further designating the landmass area being represented by said wild card;

b. The back side of said wild cards being visually-similar to the back sides of the Suit cards of said retain informational deck, said backsides having said first indicia thereon, said first indicia indicating the landmass area being represented by said deck and further including the name of the main informational deck to which said wild card belonging.

10. A method for playing a geography card game called BOP! wherein the game includes a Country Card Deck of playing cards and a Blotswanna Card Deck of playing cards, composing the steps of:

a. providing a Country Card Deck and a Blotswanna Card Deck (1) said Country Card Deck having a plurality of regional suit cards and one or more Continent Wild Cards, (a) the cards in said Country Card Deck having a first indicia representing a landmass area; said landmass area being divided into smaller areas or regions and one or more of said regions having a plurality of major political units being located therein;

(b) the cards in each of said regional suits having a second indicia representing one of said regions wherein each region is represented by a different regional suit; said second indicia including a commonly accepted name for the landmass area being represented by said deck and one or more terms taken from the group consisting of directional locators, positional locators, and type of landmass locators, (c) the cards in each of said regional suits being divided into Country Cards and place-filler cards, one or more of said regional suits having a plurality of Country Cards and one or more place-filler cards;

1) each of said Country Cards having a third indica representing one of the major political units being located within said regions, 2) said place-filler cards including undefined place-filler cards having no third indicia, said undefined place-filler cards representing all of the places and all of the things being located within said regions such that said region being represented as a whole, (d) each of said place-filler cards having a fourth indicia, said fourth indicia designating said place-filler cards as beings Region Cards (e) said Country Card Deck also including one or more of said place-filler cards, said place-filler cards including defined place-filler cards having no third indicia, and having a fifth indicia, said fifth indicia representing a specific place or thing being located within said region, said defined place-filler cards also being called region cards, (f) where said Country Card Deck representing a continental landmass area:

1) each of said Country Cards representing one country, said country being located within one of said regions being represented by one of said regional suits;

2) said place-filler cards being place-filler cards selected from the group consisting of defined place-filler cards and undefined place-filler cards, said place-filler cards being selected from the group consisting of defined place-tiller cards and undefined place-filler cards also being called region cards, (g) each of said country cards and each of said region cards having a front side and a back side;

1) the back side of said country cards and the back side of said region cards being visually-similar, said backsides having said first indicia thereon, said first indicia indicating the continental landmass area being represented by said deck and further indicating the name of the Country Card Deck to which said country cards and said region cards belonging;

2) die front side of each of said country cards being distinctive having said second indicia and said third indicia thereon, said second indicia indicating the regional suit to which said country card belonging and said third indicia indicating the name of the country being represented by said country card;

3) the froth side of said region cards being distinctive having said second indicia and said fourth indicia thereon, said second indicia indicating the regional suit to which said region card belonging, said fourth indicia further designating said card as being a region card, and where said region card being a deigned region card, said defined region card having a fifth indicia, said fifth indicia further indicating a specific place or thing being located within said region, said specific place or thing also being represented by said defined region card, (h) said wild cards being called Continent Wild Cards;

1) each of said Continent Wild Cards representing the continental landmass area being represented by said deck;

2) each of said Continent Wild Cards having a front side and a back side, 3) the front side of each of said wild cards being distinctive having a fifth indicia thereon designating said card as being a wild card and further designating the continental landmass area being represented by said wild card;

4) the back side of each of said wild cards being visually-similar to the back sides of the Suit cards of said deck, said backsides having said first indicia thereon, said first indicia indicating the continental landmass area being represented by said deck and further including the name of the Country Card Deck to which said wild card belonging, (2) said Blotswanna Card Deck of playing cards having a plurality of cards and a plurality of sets of cards:

(a) each card of said Blotswanna Card Deck having a numerical value imprinted thereon, said numerical value assigning a point value to certain cards of said Country Card Deck from hand-to-hand or round-to-round of card play, each card of said Blotswanna Card Deck further having a phrase imprinted thereon, said phrase referencing one or more regional suits of said Country Card Deck of cards, said phrase being called a mandate, said phrase also being called a card mandate;

(b) each set of cards in said Blotswanna Card Deck having a predetermined number of cards, the cards of a particular set of Blotswanna Card Deck cards each having the same mandate, said mandate referencing one or more of the regional suits of said Country Card Deck of cards and the mandate of any particular set of cards being different from the mandates of other sets of cards in said companion card deck, each of said mandates identifying a particular combination of cards needing compilation for a particular hand or round of card play;

(c) each card of a particular set of Blotswanna Card Deck cards having a numerical value different from the numerical values imprinted on other of the cards of said particular set of cards;

(d) each card of said Blotswanna Card Deck having a front side and a back side:

1) the front side of said Blotswanna Card Deck cards being distinctive, each of said front sides having specific information thereon, said specific information including a mandate describing a particular combination of cards needing compilation from the cards of said Country Card Deck, said specific information including a numerical value thereon, said number assigning a point value to each of the cards of said particular combination of cards being described on said Blotswanna Card Deck card;

2) the back side of each of said cards being visually-similar, said back sides having said first indicia thereon, said first indicia indicating a continental landmass area being represented by the cards of said informational deck and further distinguishing the cards of said Blotswanna Card Deck form the cards of said Country Card Deck, b. getting ready to play the hand (1) using standard playing card shuffling, cutting, and dealing procedures, dealing one of the plurality of Blotswanna cards with its front side down to each of the game players, in rotation, so that each of said players having one Blotswanna card (2) after dealing from said Blotswanna Card Deck, said Blotswanna Card Deck being placed aside, front side down, and such that said deck of Blotswanna cards being visible to all players at all time during said hand of play (3) using standard shuffling, cutting, and dealing procedures, dealing the cards of the Country Card Deck face down, one at a time to each player in clockwise rotation, to create a predetermined number of cards in the hands of each of the players (4) placing the remaining cards of the Country Card Deck, front side down, on to the lop center of the playing surface (5) alter steps b(1) through b(4), holding each of their card hands by the player who has been dealt the hand, so that the front side of each player's cards faces the player, with only the back sides of the hand of cards being visible to other players, said hand of cards now comprising one Blotswanna card and said predetermined number of cards from the Country Card Deck;

c. playing the hand (1) beginning with the player on the left hand side of the dealer, said player pulls one card from the Country Card Deck, keeping the front side of the just pulled card face down such that only the back side of the card is visible to other players, said player on the left hand side of the dealer is player #1, (2) examining of said just pulled card by player #1, player #1 must decide whether to keep the just pulled card or whether to discard said just pulled card, (a) if said just pulled card is of the same regional suit as one or more of the cards in player #1's hand, player #1 may decide to keep said just pulled card in his hand, (b) if deciding to keep said just pulled card, player #1 must discard a card from his hand of cards in exchange for the card he keeps;

(c) if said just pulled card does not belong to the same regional suit as one or more of the cards in player #1 's hand, player #1 may decide to discard the just pulled card, (d) or alternatively, if the just pulled card enables player #1 to fulfill his Blotswanna Card Mandate, player #1 may call out BOP!

(3) discarding a card means to lay said card in the center of the playing surface, front side up, next to the Country Card Deck, (4) beginning discard pile by step c(3) and ending player #1 's turn at play if player #1 not having called BOP!, (5) playing turn moving to the player on the left side of player #1 if BOP! not having been Called by player #1, the player on the left side of player #1 is called player #2

(6) examining of said discarded card by player #2, player #2 must decide whether to (a) pick up the discarded card from the discard pile and add said picked up card to to his hand, (b) or instead of picking up the discarded card, player #2 may pull a card from said Country Card Deck, (c) picking up said card from the discard pile obligates player #2 to forego pulling from said Country Card Deck, picking up a card from the discard pile and adding the card to said player #2's hand obligates player #2 to discard a card from his hand in exchange for the card just picked up from the discard pile, (d) or alternatively, if the picked up card enables player #1 to fulfill his Blotswanna Card Mandate, player #1 may call out BOP!

(7) deciding not to pick up a card from the discard pile obligates player #2 to pull one card from the Country Card Deck (8) pulling a card from the Country Card Deck by player #2, (9) examining of said just pulled card by player #2, player #2 must decide whether to keep the just pulled card or whether to discard said just pulled card, (a) if said just pulled card is of the same regional suit as one or more of the cards in player #2's hand, player #2 may decide to keep said just pulled card in his hand, (b) if deciding to keep said just pulled card, player #2 must discard a card from his hand of cards in exchange for the card he keeps;

(c) if said just pulled card does not belong to the same regional suit as one or more of the cards in player #2's hand, player #2 may decide to discard the just pulled card;

(d) or alternatively, if the just pulled card enables player #2 to fulfill his Blotswanna Card Mandate, player #1 may call out BOP!

(10) discarding a card to the discard pile ends player #2's turn at play if player #2 has not bopped,

(11) playing turn moving to the player on the left side of player #2, if player #2 having not called BOP!, the player on the left side of player #2 becomes the next player

(12) examining of said discarded card by said next player, said player must decide whether to (a) pick up the discarded card from the discard pile and add said picked up card to to his hand, (b) or instead of picking up the discarded card, said next player may pull a card from said Country Card Deck, (c) picking up said card from the discard pile obligates said next player to forego pulling from said Country Card Deck, picking up a card from the discard pile and adding the card to said next player's hand obligates the player to discard a card from his hand in exchange for the card just picked up from the discard pile, (d) or alternatively, if the picked up card enables the player to fulfill his Blotswanna Card Mandate, said next player may call out BOP!

(13) deciding not to pick up a card from the discard pile obligates the player to pull one card from the Country Card Deck

(14) pulling a Card from the Country Card Deck by said next player

(15) examining of said pulled card by said player, said next player must decide whether to keep the just pulled card or whether to discard said just pulled card, (a) if the just pulled card is from the same regional suit as one or more of the cards in said player's hand, said player may decide to keep the just pulled card, (b) if deciding to keep the just pulled card, the player must discard a card from his hand of cards in exchange for the card he is keeping, (c) if said just pulled card does not belong to the same regional suit as one or more of the cards in said player's hand, said player may decide to discard the just pulled card;

(d) or alternatively, if the just pulled card enables said player to fulfill his Blotswanna Card Mandate, said player may call out BOP!

(16) adding a card to the discard pile ends said next player's turn at play if he has not bopped and the playing turn then moves to the player on the left of said next player

(17) repeating of steps c(12) through c(16) until a player bops d. bopping (1) fulfilling the Blotswanna Card mandate for the hand at play is called bopping, (2) hopping occurring from 1 of 3 possible scenarios:

(a) being dealt hand corresponding to Blotswanna Card Mandate (b) pulling a card from said Country Card Deck wherein said pulled card bringing said hand in compliance with said Blotswanna Card Mandate, or, (c) picking up a card from said discard pile and said picked up card bringing said hand in compliance with said Blotswanna Card Mandate (3) bopping by a player only being allowed during said player's turn at play (4) calling BOP! prior to discarding a Country Card preserving said player's claim to Blotswanna Card assigned points for said hand of play (5) bopping player laying out said bopping player's hand, front side up, on said playing surface, said hand being spread out such that said Blotswanna Card and said Country Card Deck cards being easily checked by other players (6) checking said player's BOP! by examining said hand, ensuring said Country Cards corresponding to said Blotswanna Card Mandate of player having called BOP!

(7) corresponding Country Cards and Blotswanna Card verifying said bopping player's claim to assigned Blotswanna Card points for the hand of play and to premium value points for each of any Continent Wild Cards being included in said player's bopping spread (8) finding that said bopping spread fulfilling Blotswanna Card Mandate obligating recording of said bopping player's points and ending said hand at play (9) finding that said player's spread not fulfilling said Blotswanna Card Mandate obligating said player to pick up his hand, discard a card from, said player's hand as needed and turn at play moving to the next player

(10) repeating of steps c(1) through c(18) and d(3) through d(9) until a predetermined number of hands constituting one complete game having been played e. scoring (1) counting the number of points being earned after bopping (2) each Country Card and each Region card being identical in point value for a particular hand of play (3) each Continent Wild Card having a predetermined point value during each game (4) points for said Country Cards and said Region Cards may vary from hand to hand, said prints being predetermined hand by hand from said point value being assigned by the Blotswanna Card dealt to players at the beginning of each hand of play (5) completing said predetermined number of bands obligating taking of total points having been earned for all hands of play in the instant game f. winning the game (1) having more points than other players obligating winning of game (2) identical total points between two or more players obligating playing of additional hands, one at a time, by all players until one player has earned more points than any tother player (3) scoring more game points than other player after completing a predetermined number of hands of play constitutes the playing of a complete game and being the game objective;

whereby knowledge will ensue about the general location of countries being located within the continental landmass area being represented by said deck.

11. A method for teaching/learning world geography wherein the method includes a Deck of World Regions Geography Playing Cards, comprising the steps of:

a. providing a Deck of Regionally Suited Geography Playing Card's wherein said duck representing a planet, said deck having a plurality of continental landmass area suits and said deck having a plurality of region suit cards, (1) each of said continental landmass area suits representing a major landmass area being located within the planet being represented by said deck, (2) the suit cards of said deck being called region cards, each of said region cards representing a division of one of said major landmass areas into smaller areas or region (3) there being 30 regions being represented in the present embodiment of said deck and two identical region cards presenting each of said regions, said World Regions Card Deck comprising a total of 60 region cards or 30 matching pairs of said region cards;

(4) there being two identical cards for each region being represented in said deck, said two identical cards also being called matching pairs, matched pairs, or pairs (5) each of the cards of ,aid World Regions Card Deck having a frontside and a backside (6) the backsides of said region cards being visually-similar having specific indicia thereon, said specific indicia indicating the planet being represented by said deck, said specific indicia further indicating the name of said deck (7) the front side of said cards of a matching pair of Region Cards being identical and distinctive from the front side of the cards of other matching pairs; said frontsides of said identical cards having specific indicia thereon, said specific indicia indicating the name of one specific subdivision located within the major landmass area being represented by said suit;

b. getting ready to play the hand (1) using standard shuffling, cutting, and dealing procedures, dealing the cards of the World Regions Card Deck face down, one at a time, to each player in clockwise rotation, to create a predetermined number of cards in the hands of each of the players such that each of said players having equal numbers of said cards (2) placing the remaining cards in the center of the playing surface, front side down, such that said World Regions Card Deck being visible to all players at all time during each hand of play (3) after steps b(1) through b(2), each player holding said player's hand such that the front side of each of the cards in said player's hand faces the player, with only the back sides of the hand of cards being visible to other players, c. playing the hand (1) beginning with the player on the left hand side of the dealer, said player pulls one card from the World Regions Card Deck, keeping the front side of the just pulled card face down such that only the back side of the card is visible to other players, said player on the left hand side of the dealer is player #1, (2) examining of said just pulled card by player #1, player #1 must decide whether said just pulled card matches one of the cards in his hand, (a) if said just pulled card matches one of the cards in player #1's hand, player #1 may decide to keep said just pulled card in his hand, (b) if deciding to keep said just pulled card, player #1 must discard a card from his hand of cards in exchange for the card he is keeping;

(c) if said just pulled card does not match another card in his hand, player #1 may decide to discard said card;

(d) or alternatively, if the just pulled card matches another card in player #1's hand and completes his hand such that the hand is then comprised of only matching pairs of Region Cards, player #1 may call out BOP!

(3) discarding a card means laying the card, front side up, next to the World Regions Card Deck, in the center of the playing surface, (4) beginning discard pile by step c(3) and ending player #1 's turn at play (5) playing turn now moving to the player on the left side of player #1 if BOP! not having been called by player #1, the player on the left side of player #1 is called player #2

(6) examining of said discarded card by player #2, player #2 must decide whether to (a) pick up the discarded card from the discard pile and add said picked up card to to his hand, (b) or instead of picking up the discarded card, player #2 may pull a card from said World Regions Card Deck, (c) picking up said card from the discard pile obligates player #2 to forego pulling from said World Regions Card Deck, picking up a card horn the discard pile and adding the card to said player #2's hand obligates player #2 to discard a card from his hand in exchange for the card just picked up from the discard pile, (d) or alternatively, if said picked up card matches another card in player #1's hand and completes his hand such that the hand is then comprised of matching pairs only, player #1 may call out BOP!

(7) deciding not to pick up a card from the discard pile obligates player #2 to pull one card from the World Regions Card Deck (8) pulling a region card from the World Regions Card Deck by player #2, (9) examining of said just pulled card by player #2, player #2 must decide whether the just pulled card matches one of the cards in his hand, (a) if said just pulled card matches one of the cards in player #2's hand, player #2 may decide to keep the just pulled card in his hand, (b) if deciding to keep the just pulled card, player #2 must discard a card front his hand of cards in exchange for the card he is keeping, (c) if the just pulled card does not match another card in his hand, player #2 may decide to discard the card;

(d) or alternatively, if the just pulled card matches another card in player #2's hand and completes his hand such that his hand is then comprised of matching pairs only player #2 may call out BOP!

(10) discarding a card to the discard pile ends player #2's turn at play if player #2 has not bopped,

(11) playing ttur i moving to the player on the left side of player #2, if player #2 having not called BOP!, the player on the left, side of player #2 becomes the next player

(12) examining of said discarded card by said next player, said next player must decide whether to (a) pick up the discarded card from the discard pile and add said picked up card to to his hand, (b) or instead of picking up the discarded card, said next player may pull a card from said World Regions Card Deck, (c) picking up said card from said discard pile obligates said player to forego pulling from said World Regions Card Deck, picking up a card From the discard pile wild adding the card to said player's hand obligates him to discard a card from his hand in exchange for the card just picked up from the discard pile, (d) or alternatively, if the just pulled card matches another card in the player's hand and completes his hand such that the hand is then comprised of matching pairs only, the player may call out BOP!

(13) deciding not to pick up a card from the discard pile obligates the player to pull one card from the World Regions Card Deck

(14) pulling a Region Card from the World Regions Card Deck by the next player

(15) examining of said just pulled card by said next player, said next player must decide whether the just pulled card matches one of the cards in his hand, (a) if the just pulled card matches one of the cards in the player's hand, the player may decide to keep the just pulled cards (b) if deciding to keep the just pulled card, the player must discard a card from his hand of cards in exchange for the card he is keeping, (c) if the just pulled card does not match another card in his hand, the player may decide to discard the card;

(d) or alternatively, if the just pulled card matches another card in the player's hand and completes his hand such that the hand is then comprised of matching pairs only, the player may call out BOP!

(16) adding a card to the discard pile ends said next player's turn at play if he has not bopped and the playing turn then moves to the player on the left of said next player

(17) repeating of steps c(12) through c(16) until a player bops d. bopping (1) compiling a band of said Region Cards having only matching pairs of said Regional Cards being called bopping (2) bopping occurring from 1 of 2 possible scenarios, (a) pulling card from said World Regions Card Deck and said pulled card making a hand having snatched pairs only, or (b) picking up a card from said discard pile, said picked up card making a hand having matched pairs only (3) bopping by a player only being allowed during said player's turn at play (4) calling BOP! signals other players that the player having called BOP! now has a hand of cards being comprised only of matching pairs (5) the bopping player must then lay out his hand, front side up, on the playing surface, the hand must be spread out so that the claimed matched pairs can be easily checked by other players (6) checking a player's bop is done by examining the bopping player's hand after the hand has been layed out on the playing surface, checking ensures that the player's hand is now comprised of only matched pairs of the region cards and verifies that the bopping player has a right to claim Region Card points for the round of play, (9) finding that the layed out hand is comprised of only matched pairs of Region Cards obligates till recording of a predetermined number of points for each matching pair in the bopping player's spread and ends the instant hand at play (9) finding non-matching pairs or any unmatched card in the player's hand means that the player must pick up his spread, discard a card from his hand and the turn at play moves to next player on the left

(10) repeating of steps b(1) through d(9) as appropriate until a predetermined number of hands constituting one complete game having been played e. scoring (1) valuing of Region Cards being a predetermined number of points for each card included in said matching pair of said Region Cards, (2) counting of the number of points earned is done only after the player's BOP! is verified (3) completing said predetermined number of hands obligates the tallying of total points earned for all hands played in the instant game f. winning the game (1) having more points than all other players obligating winning of said game (2) identical total points between two or more players obligates the playing of additional hands, one at a time, until one of the players has more points than any of the other players (3) scoring more game points than any of said other players at the end of a predetermined number of hands of play constitutes the playing of a couplets game and is the game objective;

whereby, regular use of said method will lead to increased knowledge about the general location of geographical regions of said landmass areas and the position of said regions within said planet.

* * * * *